US006877697B2

(12) United States Patent
Bellacera

(10) Patent No.: US 6,877,697 B2
(45) Date of Patent: Apr. 12, 2005

(54) KITE CONTROL SYSTEMS

(76) Inventor: John D. Bellacera, P.O. Box 859, White Salmon, WA (US) 98672

( * ) Notice: Subject to any disclaimer, the term of this patent is extended or adjusted under 35 U.S.C. 154(b) by 0 days.

(21) Appl. No.: 10/602,183

(22) Filed: Jun. 23, 2003

(65) Prior Publication Data

US 2004/0065780 A1 Apr. 8, 2004

Related U.S. Application Data

(63) Continuation-in-part of application No. 09/990,758, filed on Nov. 16, 2001, now Pat. No. 6,581,879.

(60) Provisional application No. 60/429,116, filed on Nov. 25, 2002, provisional application No. 60/249,844, filed on Nov. 16, 2000, and provisional application No. 60/283,048, filed on Apr. 11, 2001.

(51) Int. Cl.[7] ..... B64C 31/06

(52) U.S. Cl. ..... 244/155 A; 244/155 R; 242/395; 242/388.6

(58) Field of Search ..... 244/155 A, 153 R, 244/142, 155 R; 242/388.6, 395, 395.1, 388.7, 396.8

(56) References Cited

U.S. PATENT DOCUMENTS

| | | | |
|---|---|---|---|
| 2,388,478 | A | 11/1945 | Garber |
| 3,338,536 | A | 8/1967 | Hull et al. |
| 3,355,129 | A | 11/1967 | Kinsey |
| 3,409,255 | A | 11/1968 | Sada |
| 4,127,247 | A | 11/1978 | Strasilla |
| 4,129,273 | A | 12/1978 | Hill |
| 4,708,078 | A | 11/1987 | Legaignoux et al. |
| 4,796,827 | A | 1/1989 | Munt, III et al. |
| 4,873,934 | A | 10/1989 | Renault |
| 4,892,272 | A | 1/1990 | Hadzicki |
| 5,024,401 | A | 6/1991 | Nakashima |
| 5,180,123 | A | 1/1993 | Lin |
| 5,366,182 | A | 11/1994 | Roeseler et al. |
| 5,417,390 | A | 5/1995 | Southwick |
| 5,575,229 | A | 11/1996 | Blackmer |
| 6,056,243 | A | 5/2000 | Prentice |
| 6,260,803 | B1 | 7/2001 | Hunts |
| 6,273,369 | B1 | 8/2001 | Nishimura et al. |
| 6,336,607 | B1 | 1/2002 | Perrier |
| 6,435,456 | B1 | 8/2002 | Clawson |

FOREIGN PATENT DOCUMENTS

| | | |
|---|---|---|
| DE | 42 23 021 A1 | 3/1993 |
| GB | 1 507 503 | 4/1978 |
| GB | 2 116 055 | 9/1983 |

OTHER PUBLICATIONS

*What's Out There: Talking About Bars*, Wilson, *Kiteboarding Magazine*, p. 75, Jan. 2003.

Wakeskate.com internet pages, pp. 1–5, printed May 11, 2003.

*What's Out There: Hamish MacDonald, Kiteboarding Magazine*, p. 74, Sep. 2003.

*Kite Bars & Sheeting Systems, Kiteboarding Magazine*, p. 88, undated.

*Primary Examiner*—Tien Dinh

(74) *Attorney, Agent, or Firm*—Kolisch Hartwell, P.C.

(57) ABSTRACT

Systems, including apparatus and methods, for controlling a power kite. The systems may include a variable-line kite controller with a rotatable spool bar carrying plural spools, or a fixed-line controller. The systems also may include deployment mechanisms, sheeting mechanisms, cleating mechanisms for the sheeting mechanisms, safety releases, line protectors, and kite boards, among others, for use with variable- and/or fixed-line controllers.

19 Claims, 18 Drawing Sheets

KITE CONTROL SYSTEMS

CROSS-REFERENCES TO PRIORITY APPLICATIONS

This application is a continuation-in-part of U.S. patent application Ser. No. 09/990,758, filed Nov. 16, 2001, now U.S. Pat. No. 6,581,879. This application also claims the benefit under 35 U.S.C. § 119(e) of U.S. Provisional Patent Application Ser. No. 60/429,116, filed Nov. 25, 2002.

U.S. patent application Ser. No. 09/990,758 claims the benefit under 35 U.S.C. § 119(e) of the following U.S. provisional patent applications: Ser. No. 60/249,844, filed Nov. 16, 2000; and Ser. No. 60/283,048, filed Apr. 11, 2001.

The above-identified U.S. and provisional patent applications are all incorporated herein by reference in their entirety for all purposes.

RELATED REFERENCES

This application incorporates by reference in their entirety for all purposes the following U.S. Pat. No. 5,366,182; issued Nov. 22, 1994; U.S. Pat. No. 6,260,803, issued Jul. 17, 2001; and U.S. Pat. No. 6,273,369, issued Aug. 14, 2001.

FIELD OF THE INVENTION

The invention relates to kite flying. More specifically, the invention relates to systems for power-kite flying, for example, when kiteboarding.

BACKGROUND OF THE INVENTION

Power kites add a new dimension to flying kites. These large kites, with a surface area greater than about two square meters, are capable of generating substantial tractive forces. These tractive forces have been used in numerous ways to convert kite flying from an almost sedentary pastime to a fast-paced and challenging sport. For example, athletes and thrill seekers have combined power kites with boards, skis, boats, sleds, and wheeled land vessels to speed across water and land.

The large forces generated by power kites demand significant operator control throughout the flight cycle, especially when the kite is conveying the kite operator. In many cases, the kite is tethered to a hand-held control bar using a fixed-length of kite line. However, the fixed-length system complicates kite launching and subsequent kite control. For example, an assistant may be needed to position and release the kite during launching, and high-traffic areas may produce long periods of waiting for sufficient launching space, or worse, may cause tangled kites lines or injures. Furthermore, fixed-length systems lack the ability to regulate the power of the kite. The operator cannot extend all lines together, in a regulated fashion using a brake mechanism, or sheet the kite, by changing its pitch, and thus power, through altering the relative lengths of the kite lines. A control bar that can vary either the absolute or the relative lengths of kite lengths would provide the operator with an easier, safer launch and greater control throughout the flight cycle.

At least two devices, described in U.S. Pat. No. 5,366,182 to Roeseler et al., and U.S. Pat. No. 6,260,803 to Hunts, include reeling mechanisms that allow the length of kite lines to be varied. However these devices are unsatisfactory for a number of reasons. For example, each device includes an inadequate brake mechanism. These brake mechanisms do not allow the kite operator to feel the rate of line output, and they rely on braking actions separate from steering. Thus, steering the kite may be impaired while attempting to apply the correct amount of drag or brake pressure. Furthermore, these brake mechanisms include mechanical parts that rely on friction. These parts may wear out or work less efficiently when wet. These devices also lack safety features, such as a safety release mechanism to depower the kite, a feature that is available for fixed-line systems. Overall, these devices are not easy to operate, lacking a simple mechanical design with few moving parts. As a result, these devices may result in decreased kite control, more power-kite related accidents, and more device malfunctions. Thus, safer, more efficient, and user-friendly systems for flying power kites are still needed.

SUMMARY OF THE INVENTION

The invention provides systems, including apparatus and methods, for launching, flying, releasing, landing, and/or rigging power kites. The systems may include a variable-line kite controller with a rotatable spool bar carrying plural control spools, or a fixed-line controller. The systems also may include deployment, braking, sheeting, cleating, and safety release mechanisms, line protectors, line organizers, and/or kite boards, among others, for use with variable- and/or fixed-line controllers.

DETAILED DESCRIPTION

The invention provides systems, including apparatus and methods, for launching, flying, releasing, landing, and/or rigging power kites for use while a kite operator is stationary or conveyed across a surface. The systems include a variable-line kite controller, or control bar, that allows the operator to vary the deployed length of kite lines, while controlling the position and dynamics of a kite, particularly the height, angle, direction, and/or speed of the kite. The controller may be lightweight, easy to operate, include few moving parts, and/or may require low maintenance. The variable-line controller may include a hand-operated braking system that uses hand pressure to regulate liner output, without movement of hands from a steering position. Furthermore, the variable-line kite controller may include a crank mechanism that facilitates ready retrieval and storage of kite lines after landing the kite.

The systems also may include other aspects that may be useful for both variable- and fixed-line controllers. For example, the invention provides sheeting mechanisms that allow the operator to regulate the kite's pitch, and thus the force exerted by the kite on the operator. These sheeting mechanisms may be regulated by cleating mechanisms that offer various linkage and cleating options between the sheeting mechanism, the controller, and/or the kite operator. In a further aspect, the invention provides a safety release. The safety release may be used to depower a kite and/or may function as a protective sheath to minimize operator injury caused by kite lines. In additional aspects, the invention also provides a kite board, a kite-line organizer, and methods for using systems of the invention to control a kite. The systems of the invention may offer a kite operator the ability to fly a kite with increased control and safety, thus directing the sport of kiteboarding and related activities towards increased acceptance and popularity.

Further aspects of the invention are described in the following sections: (I) power kite systems; (II) variable-line kite control systems, including A) deployment mechanisms, B) locking and crank mechanisms, C) sheeting mechanisms, and D) safety mechanisms; (III) alternative variable-line control systems; (IV) fixed-line control systems; (V) kite boards; (VI) rigging and operating a kite control system, including A) rigging a kite and organizing control lines, B) launching the kite, C) sheeting the kite, and D) landing the kite and retrieving control lines; and (VII) comparison of two-line and four-line kite control systems.

I. Power Kite Systems

Figure 1:
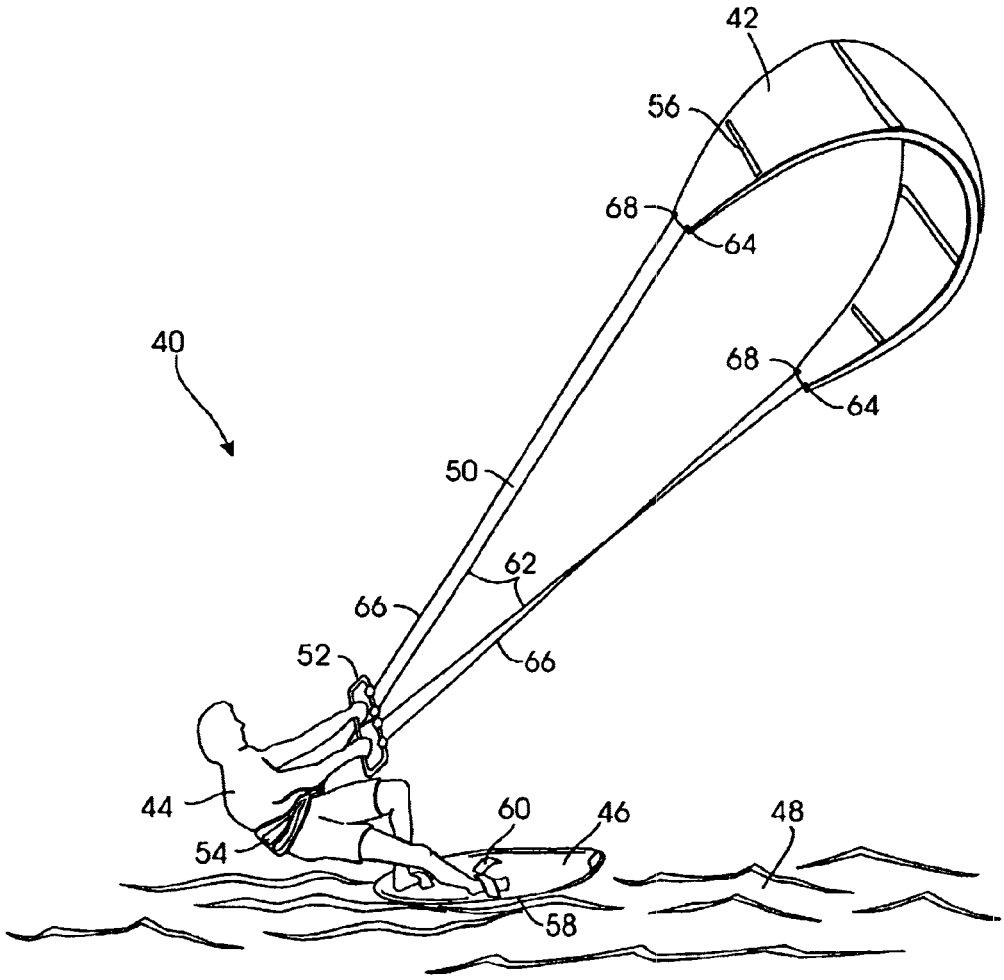
FIG. 1 is a perspective view of a person on a kite board controlling a power kite using a kite controller, in accordance with aspects of the invention.

This section describes the elements of a power kite system and how these elements are physically and functionally interconnected; see FIG. 1. In a power kite system 40, a kite 42 may be used to pull a kite operator 44 (a person) on a conveyance platform 46, in this case, a kite board, across a surface 48. The kite is connected to the operator by one or more control lines 50 (in this case, four) attached to a kite controller 52. The kite controller, also referred to as a kite control bar, may be grasped by the operator and/or linked to the operator, for example, with a harness 54 through a spreader bar with a hook or a hook-shackle combination.

The kite 42 generally comprises any tethered flying device or airfoil launched from a surface such as the ground or water and elevated above the surface by an interplay of forces provided by the wind, the control lines, and gravity. Here, wind refers to the force of moving air, which may be created by air moving relative to the kite (as in a kite flown from the ground) and/or the kite moving relative to the air (as in a kite pulled behind a boat). Wind may be at least about 10 knots up to about 40 knots or more. Power kites may be flown by a stationary operator or used to generate a tractive conveyance force and flown by a moving operator.

Kites generally have a surface-to-mass ratio sufficient to convert wind resistance into a net upward force, determined at least partially by the size, shape, and composition of the kite. The overall surface area of a kite is an important determinant of the tractive force it generates. Power kites, which generally comprise any kite large enough to pull an operator across a surface, may have an area of at least about two square meters up to much greater than twenty square meters. Such kites may have a width of about two meters to about eight meters or more. Kites may be constructed from planar sheets comprising low-density materials that impede or block airflow, including, but not limited to, cotton, paper, and/or plastics, such as polyesters (e.g., Mylar and/or Dacron), polyurethane, vinyl, and/or nylon, among others. The shape of a kite may be determined by a combination of factors, including the overall shape of the materials, and the position of supporting elements 56, such as inflatable and/or inherently rigid struts, bridles, tubes, spars, and/or battens, which provide localized rigidity or structurally link portions of the kite. Preferred supporting elements include inflatable struts, which may be inflated by mouth or by using a suitable pump, such as a hand pump. Alternatively, or in addition, kites may be constructed of an airtight material and inflated with a gas or the wind to produce a more rigid three-dimensional structure.

The kite operator 44 generally comprises any person or persons linked to the power train of the kite. The kite may be flown by a stationary or moving operator.

The conveyance platform 46 generally comprises any structure or device that can be pulled over a surface by the force of the kite. Conveyance platforms may be capable of transverse movement relative to the force generated by a kite and should be strong enough to support the weight of a kite operator. For movement on water, the conveyance platform should have a positive buoyancy in water and a surface area equal to, but generally much greater than, the surface area of the feet of the kite operator. The platform may have a tracking capability to define a direction of motion transverse to the direction of the wind, for example, provided by a fin or board edge 58 in water, by a runner on ice, or by wheels on land. This tracking capability may allow tacking in order to return to the starting point of a kiting session. In addition, the platform may include means, such as straps 60, detachable boots, indentations, or protrusions for stabilizing the position of the operator's feet. Suitable buoyant conveyance platforms include a kite board (shown in FIGS. 1 and 20–22), a single ski or pair of skis, or a single or double-hulled boat, among others. Alternatively, the operator's feet may serve as the conveyance platform that contacts the water. In addition to water, the kite operator may be conveyed on other suitable surfaces using an appropriate conveyance platform, such as a ski, an all-terrain board, a snowboard, a sand buggy, a wheeled vehicle, roller skates, or a sled.

The surface 48 generally comprises any boundary capable of slidingly supporting a conveyance platform. Suitable surfaces may include water (shown in FIG. 1), ice, sand, packed dirt, and concrete, among others. Because the conveyance platform is selected based on its ability to be pulled readily across the surface, the surface determines the most suitable subset of conveyance platforms. For example, a board or skis may be suitable on water, a wheeled vehicle or skates may be suitable on solid surfaces such as ice, packed dirt, or concrete, and a sled may be suitable on ice or sand.

The control line 50 generally comprises any elongate tethering material capable of coupling a kite (and the force generated by the kite) to a kite controller. The control line may be a kite line that directly connects the controller to the kite or also may include a lead line, generally of greater diameter than the kite line. The lead line may link the kite line to the controller and may provide a line that is more readily grasped by the operator and less likely to produce injury. The control lines may include two, three, four, or more lines connected to the kite at plural sites. In some embodiments, a subset of the control lines may be connected to a sheeting mechanism that is included in the kite, as described in more detail in Section IV.

As shown in FIG. 1, plural lines may extend to the front and back of the kite: one or more central or sheeting lines 62 may extend to the front of the kite, in this case the front corners 64 of the kite, and two outer or steering lines 66 may extend to the rear corners 68 of the kite. Changing the relative lengths of control lines during kite flying, and thus the power exerted by the kite, is referred to as sheeting. Generally, sheeting is effected by changing the relative deployed lengths of control lines that extend to the front and back of the kite. Sheeting mechanisms and their use are described in more detail in Sections II.C, IV, and VI.C.

Other numbers and distributions of control lines may be suitable. For example, two steering lines and no sheeting lines may extend to the kite, and the kite may be bridled to distribute the winds force to these steering lines. However, this arrangement of control lines generally does not allow sheeting. In some embodiments, a plurality of control lines attached, to edges of a kite may extend away from the kite and unite at a position between the kite and the operator. This configuration may be used to convert a plurality of control lines attached at strategic positions such as edges to the kite into a reduced number of control lines that extend to the operator. A comparison of two- and four-line kite control systems is included in Section VII.

The magnitude of the force produced by the tethered kite, which is determined largely by the kite's surface area and the prevailing wind conditions, may guide the operator in selecting the diameter and composition of control lines. Generally, the control lines should be capable of withstanding, without breaking, the maximum force generated by the kite during normal usage. Each power kite lines is generally capable of withstanding a weight of about 300 to 600 lbs. Suitable lines may include monofilament or braided string, cord, cable, and rope, among others. Suitable materials may include plastics, cotton, and/or hemp, among others. Preferred materials may be lightweight and/or waxed and may include Dacron, Kevlar, and/or Spectra, among others. Control lines may be slightly elastic to help insulate the kite operator from sudden changes in wind speed. Moreover, control lines may include a replaceable, breakaway component, functioning like a circuit breaker, configured to break before the line if a sudden very strong pull threatens the safety of the operator or the integrity of the kite controller. Alternatively, or in addition, the control lines may include a quick disconnect that may be volitionally activated by the operator. Each control line also may include a sheath that encompasses a portion of the line and slides relative to the line. Line sheaths are described in more detail in Section II.D.

The kite controller 52 generally comprises any device for connecting the body of the operator to the pull of the control lines. The kite controller may be a variable-line device, in which the length of deployed control lines, referred to as their effective length, is variably controllable by the operator. Variable-line controllers may enable the deployed length of all control lines to be adjusted in parallel. Such a variable-line control bar may have an independently rotatable portion capable of directly unspooling and rewinding the control lines along the direction of the kite (and typically along a main axis of the controller). Alternatively, the kite controller may be a fixed-line device. A fixed-line controller may include any kite control device for which the deployed length of some or all of the control lines is predetermined, generally before launching the kite. Accordingly, a fixed-line controller may have a pre-set length of control line extended prior to launch. Either type of kite controller may be configured so that the kite operator may directly grasp the controller with both hands to regulate the spatial orientation of the controller and thus the flight path of the kite. To effectively tether a power kite, the controller may be configured to withstand a tractive force of at least about 200 pounds. Variable-line controllers and their operation are described in more detail in Sections II, III, VI, and VII, and fixed-line controllers in Sections IV and VI.

The harness 54 generally comprises any mechanism for connecting the kite controller toe the operator's body, both to disperse the force to something other than the hands and to prevent separation of the kite controller from the operator. A harness may be connected to a bridle on the controller, coupled to a sheeting mechanism, and or linked directly to a body or handle of the controller, for example, using a spreader bar or a spreader-shackle combination. The harness should be strong enough to withstand the entire force generated by the kite, and generally extends around the waist and/or torso of the operator. The harness may be formed of any material having sufficient strength and/or flexibility, such as braided Dacron sleeved with flexible PVC tubing, woven, nylon, and/or leather. Use of a harness to link the operator to the kite controller is described in more detail in Sections II.C–D, IV, and VI.C.

II. Variable-Line Kite Control Systems

This section describes variable-line kite control systems, particularly a four-line system, that may include a four-line controller having spooling, locking, crank, sheeting, and safety mechanisms, in accordance with aspects of the invention; see FIGS. 2–15. Particular aspects of the variable-line kite control systems also may be suitable for fixed-line kite control systems, as indicated below.

Figure 2:
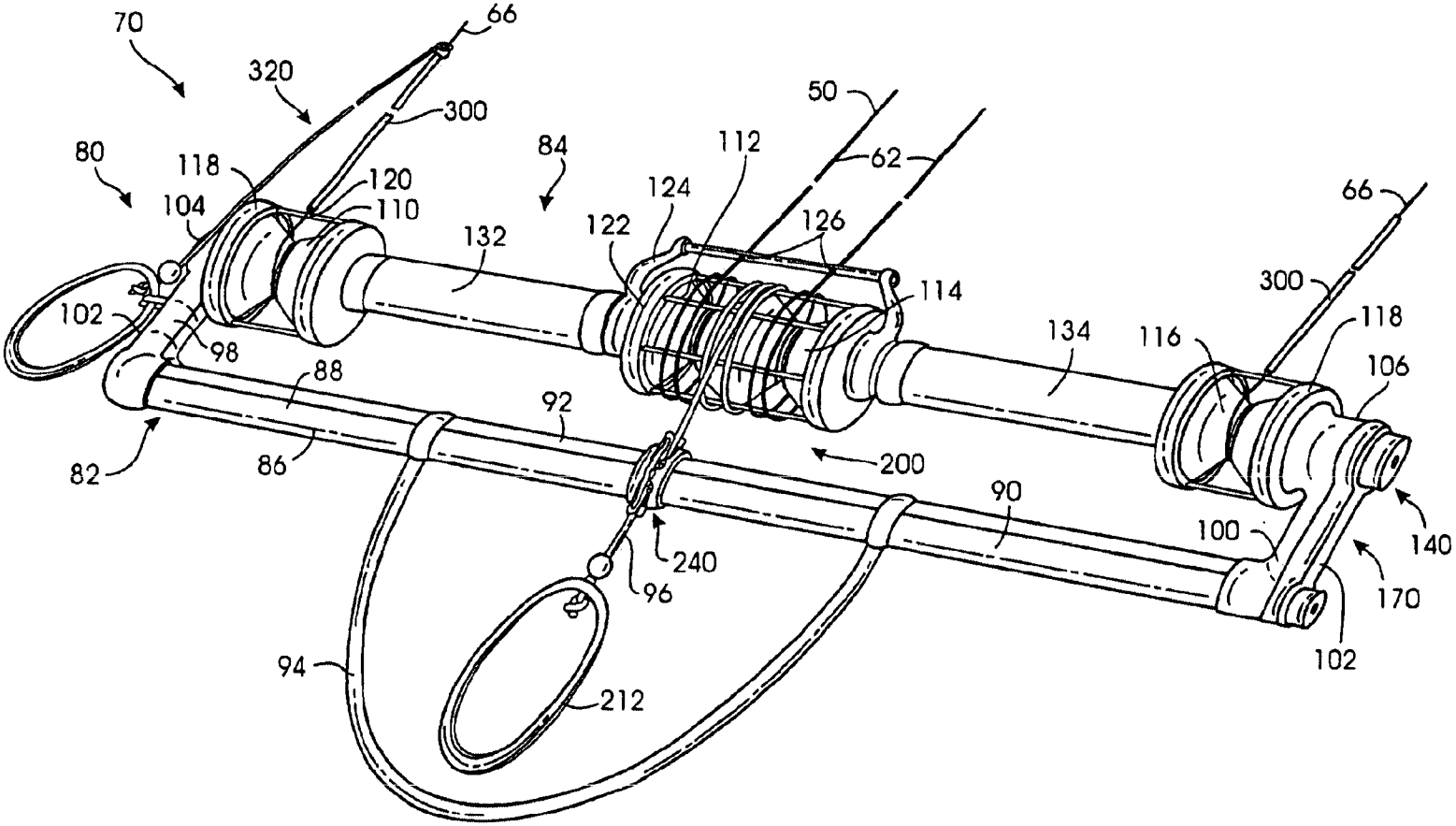
FIG. 2 is a fragmentary perspective view of a kite control system that includes a variable-line kite controller configured to hold four kite lines, in accordance with aspects of the invention.
Figure 3:
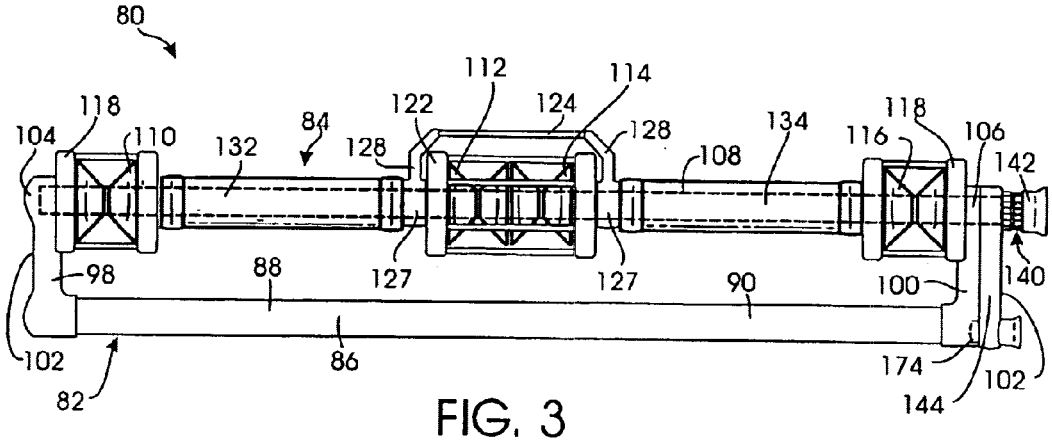
FIG. 3 is a plan view of selected aspects of the kite controller of FIG. 2 in an unlocked configuration, showing spool bar components in bold that are mounted on, and rotationally linked to, an underlying spool-bar shaft.

A four-line kite control system 70 is shown in FIG. 2, organized by variable-line controller 80, with selected aspects shown in FIG. 3. Controller 80 may include a body with a frame 82 that holds a spool bar 84. The spool bar has an axis of rotation. The frame generally comprises any structure that supports the spool bar and which enables the operator to control the spatial position of the spool bar. The frame may be coupled directly or indirectly to the spool bar. The frame further may function to define the orientation and position of the spool bars rotational axis, and thus the tension on control lines.

The frame includes a handle portion 86 that provides a structure for linking the operator to the controller. The handle portion may include gripping regions 88, 90 disposed along the handle portion. The gripping regions provide sites for the operators hands to grasp the handle portion and may include a textured and/or compressible material 92, such as rubber or plastic foam, distributed partially or completely along the gripping regions for additional comfort or to improve the operator's grip. In addition, the handle portion may provide an attachment site for a harness bridle 94 and a sheeting regulator 96, as described below. The handle portion may be spaced from spool bar 84, that is, the handle portion may have a long axis that is spaced from the rotational axis of the spool bar. Alternatively, or in addition, the handle portion may extend generally parallel to the spool bar. By spacing the handle portion from the spool bar, controller 80 may be handled much like a single bar, freeing the operator to steer the kite without interference from the spool bar. This feature may be important for performance riders, where spins, jumps, one-handed kite steering, and numerous other tricks apply.

The handle portion may include end regions 98, 100. The end regions may extend generally normal (as shown in controller 80) or obliquely to the handle portion and/or the spool bar. Alternatively, or in addition, the ends regions may be continuous extensions of the handle portion that bend away from the handle portion. One or both end regions may serve as winding posts around which control lines may be wound horizontally and stored as an alternative to, or in addition to, the spool bar. Retention of control lines wound around the long axis of controller 80 may be facilitated by a concave region 102 on each winding post (see FIG. 3) formed by protruding structures such as knobs, flanges, bumps, and the like. The winding posts may be designed with radius edges to prevent injury and aid in manually unwinding the line around the end posts. A distal section 104, 106 of each end region may accept an end portion of spool bar 84 to define the spool bar's axis of rotation. This combination of handle portion and end regions may improve frame stability, provide positions for hand placement, and facilitate attachment of other linkage mechanisms, such as a harness bridle and/or sheeting mechanism (see below).

The materials and dimensions of the frame may be selected based on kite size and wind strength. Each component of the frame may be constructed of strong, low-density composites comprising elements such as aluminum, titanium, and/or carbon to withstand the force generated by a power kite, at least about 200 lbs. Although the frame may have a circular or elliptical cross-section, other geometries such as rectangular may provide a suitable alternative at some or all positions along the frame. The frame may be formed integrally, with the end regions continuous with the handle portion, or the handle portion may be formed separately from the end regions. In controller 80, handle portion 86 is a tube or bar that fits into recessed portions molded in end regions 98, 100 (see FIG. 3). The width of the frame generally determines steering efficiency. Larger kites may use a wider frame, about 26" to 32"; mid-sized kites may use a frame with a width of about 22" to 26"; and small kites may use a frame with a width of about 18" to 22", particularly with high winds. Using an oversized frame with a small kite may result in oversteering the kite, thus causing the operator to flounder more often. With high winds of 30–40 knots or more, the oversized frame may be especially dangerous. In contrast, an undersized frame with a large kite provides less of a mechanical advantage and may tend to fatigue the operator rapidly.

The overall geometry of the controller may be determined by the combination of the frame and spool bar. For example, the handle portion may be joined at an angle, $90+\theta$, and the end regions joined with the spool bar at an angle of $90-\theta$, to create a trapezoidal structure; The angle $\theta$ may be positive, negative, or zero. Alternatively, either the handle portion or end regions may be partially or completely arcuate and may join at an angle up to 180 degrees. As shown in FIGS. 2 and 3, the controller may have a substantially planar, rectangular configuration. Alternatively, portions of the controller may be rounded (for example, to produce a D-shape) to reduce sharp corners that may cause injuries and/or to facilitate manufacturing. Although various sizes and weight may be suitable, overall the controller should be less dense than water so that it floats, and thus may include foamed polymers as structural fillers in some interior regions of the frame and/or spool bar. By using lightweight materials, such as carbon tubes, aluminum and lightweight alloys, nylon type plastics, and few mechanical parts, the controller weigh less than about five pounds (2.3 kg), or more typically, less than about three pounds (1.4 kg).

A. Deployment Mechanisms

The spool bar rotates relative to the frame, defining an ability for a kite controller to vary the length of the control lines. A spool bar generally comprises any structure that includes plural control spools and has a deployment mechanism capable of deploying power kite lines from a stored position. The spool bar may be elongate and may have the plural spools fixedly mounted relative to each other so that they turn together without slippage. Rotation of the spool bar about its long axis may deploy kite control lines through synchronous rotation of control spools. Thus, the control line leaves and enters the control spool along the direction of the kite, reducing stresses associated with deploying the line laterally, as in some prior art devices.

A control spool generally comprises any structure capable of anchoring a control line and retrieving and deploying the control line, through rotational motion. Spools function as components of the spool bar, guiding an incoming or outgoing control line onto or off of a rotating spool bar, respectively. Spools may have an increased diameter at their lateral edges to bias spooling of the control line toward more central regions of the spool. Any change in the diameter of the spool along its rotational axis may be gradual, to produce a contoured profile, or discontinuous, to produce a stepwise profile. Control spools may be deep enough to hold a desired length of control line. Furthermore, spools may be constructed of any suitable material that is strong and lightweight, such as an aluminum alloy, a composite, and/or plastic.

The structure of spool bar 84 of controller 80 is shown in FIGS. 2 and 3. However, for the following discussion, please refer particularly to FIG. 3, which illustrates, in bold, coupled synchronously rotating components of the spool bar. Spool bar 84 may include a shaft 108 (shown dotted), extending between recesses formed on frame 82, generally defined by end regions 98, 100. Shaft 108 provides a rotatable platform on which spool bar spool bar may be coupled to one another.

Spool bar 84 includes plural spools 110, 112, 114, 116 fixedly mounted on shaft 108. Thus, these four spools may rotate synchronously. Each spool carries one of four control lines 50 from a kite. Front or sheeting lines 62 typically extend to central spools 112, 114 and rear, steering lines 66 to outer or lateral spools 110, 116.

Each spool may be surrounded by a housing. A housing generally comprises any frame or other structure that at least partially encloses a spool and may protect and/or position control lines. A housing may be coupled to the frame and/or spool bar. When coupled to the spool bar, the housing may be freely rotatable relative to the spool bar. The housing may be composed of a lightweight material, such as plastic or an aluminum alloy. Furthermore, this material may be partially or substantially transparent, for example, when the housing substantially covers the spool to facilitate monitoring the disposition of the control lines on the spools. The housing generally includes a site for guiding the control line to the spool. For example, the housing may include an aperture, guide, or roller, such as, aluminum eyelet or a nylon roller, through or over which the control line may be unwound and rewound. The housing may help to exclude dirt and other debris from the line and spool and may protect the operator from hand injury.

Spool housings on controller 80 are shown in FIG. 3 (see also FIGS. 2, 4C, 7A–B, and 8). Lateral spools 100, 116 each include a lateral housing 118 that is attached to an end region (98 or 100). In some embodiments, the housing may be an extension of the end region that at least partially covers portions of the spool proximal to the operator. Each lateral housing 118 may include an aperture 120 (see FIG. 2) to guide steering line 66.

Central housing 122 may surround both central spools 112, 114. However, in contrast to each lateral housing, the central housing is generally not attached to the frame 82, but is coupled to spool bar 84 go that the housing is rotatable relative to the spool bar and spools. The central housing may include apertures or guides that direct control lines to and from the central spools (described below).

Control lines extending from the central spools also may be positioned by a floating guide 124 carrying apertures or guides 126 (FIGS. 2, 7A–B, and 8). The apertures may be oversized, allowing easy passage of the kite lines. Floating guide 124 includes sleeves 127 joined to arms 128 (FIG. 3). The sleeves flank the central housing 122 and central spools 112, 114, with the arms extending to meet adjacent the housing and spools. Floating guide 124 may rotate freely relative to central housing 122 and spool bar 84 in order minimize friction during kite control, steering, and sheeting (see below). For example, the floating guide may keep the control lines in alignment and extend kiteward from the controller when the control lines are wound over the spool housing, during kite sheeting. The roles of the central housing and the floating guide in sheeting mechanisms are described in more detail in Section II.C below.

The kite controller may include a brake mechanism. A brake mechanism generally comprises any mechanism for impeding or blocking the rotation of the spool bar. The brake mechanism may couple rotation of the spool bar to the frame. For example, the brake mechanism may provide regulated frictional contact between a region of the spool bar and the frame. This frictional braking contact may be between a stationary component of the frame and an end or circumferential portion of the spool bar. In distinct braking modes, the spool bar may rotate freely, rotate with impeded motion, or be substantially locked in position, unable to rotate. An adjustable drag mechanism that may function as a brake mechanism is described in more detail below in relation to FIG. 6.

Alternatively, the brake may directly link rotation of the spool bar to the operator. In this case, the spool bar may also include a brake region, such as brake regions 132, 134 of controller 80, shown in FIGS. 2 and 3. A brake region generally comprises any control region of the spool bar configured to be grasped by a hand of the operator in order to regulate or stop the rotation of the spool bar through frictional contact between the hand and the spool bar. The brake regions may be positioned and dimensioned to allow the operator to support the kite controller and steer the kite while regulating the release of control lines, without moving the hands. For example, brake regions may be used during a kite launch or for re-adjustment of line length due to changed wind conditions. Furthermore, brake regions may have an increased diameter, contoured surface, and/or distinct material to improve applying the brakes. For example, the brake regions may have a coating that is rubber or a plastic mesh, although a smooth, bare surface such as an anodized aluminum or polished carbon fiber may be more suitable due to its lower abrasiveness, especially when wet.

Figure 4A:
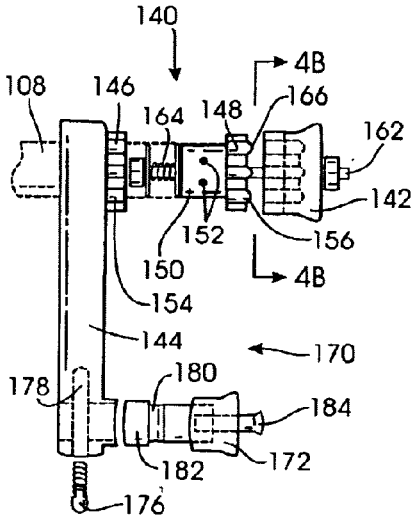
FIG. 4A is an exploded, fragmentary view of the kite controller of FIG. 2, illustrating locking and crank mechanisms that control the spool bar.

FIGS. 3 and 4A illustrate further aspects of spool bar components and structure. In FIG. 3, components that are rotationally linked on spool bar 84 are shown in bold lines. Thus, the four spools and the brake regions revolve synchronously, whereas the housings 118, 122 and floating guide 124 either do not rotate relative to the frame or are rotatable independently from the spool bar. Shaft 108 defines the central axis of the spool bar and extends into each end region of the frame. The shaft may provide an attachment site for each spool and brake region along the shafts axis. In contrast, the shaft may extend through rotationally unlinked components, such as the spool housings and the floating guide, but is generally not secured to these unlinked components.

B. Locking and Crank Mechanisms

The spool bar may have a locking mechanism to convert the spool bar between a locked and a freely rotating, unlocked configuration. The locking mechanism may be any structure or assembly that links rotation of the spool bar directly or indirectly to rotation of the frame. The locking mechanism may have a binary configuration that either locks or unlocks rotation of the spool bar.

Figure 4B:
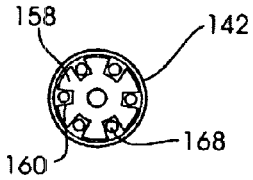
FIG. 4B is a side elevation view of FIG. 4A, viewed generally along line 4B—4B of FIG. 4A.
Figure 4C:
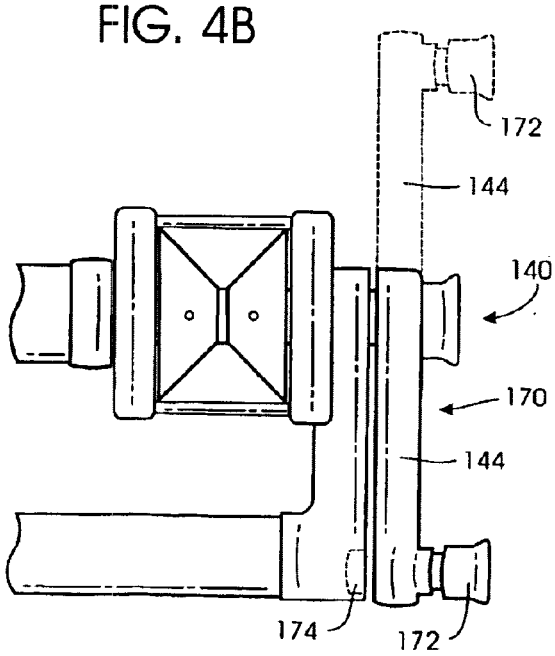
FIG. 4C is a fragmentary plan view of the kite controller of FIG. 2, showing the crank mechanism's stored and released positions.

Controller 80 includes a binary locking mechanism 140 that links rotation of the spool bar to the frame through a crank arm attached to the frame; see FIGS. 2–4. Locking mechanism 140 positions a movable switch 142, in this case a knob, either in (FIG. 4C), or out of (FIG. 3), contact with frame 82 and spool bar 84. An axial portion of arm 144 may define a retention structure 146 on the frame, in this case an arm gear, which is coaxial with a spool bar retention structure 148, in this case a spool-bar gear (see FIG. 4A). Gears 146 and 148 are attached to, or integral with, crank arm 144 and spool bar 84, respectively. In this example, arm gear 146 is formed integrally with the crank arm, whereas spool-bar gear 148 includes a base 150 that extends inside of shaft 108 and is fixed in position with fasteners 152. Teeth 154, 156 of gears 146 and 148 are alignable, so that a complementary recess 158, defined in part by teeth 160 inside of knob 142, fits over (and generally conceals) the aligned gears to fix the position of the gears relative to each other and lock the spool bar in place. Knob 142 is spring-biased to this locked position, by a fastener 162 that extends through the knob and gear 148 and positions a spring 164 adjacent to base portion 150.

The spool bar may be unlocked and locked as follows. To unlock the spool bar, an axially directed, outward force on knob 142 compresses spring 164, allowing the knob to slide outward to the unlocked position of FIG. 3. Teeth 154 of arm gear 146 may be slightly undersized relative to teeth 156 of spool-bar gear 148 to facilitate movement of the knob while the control lines are under tension; manual back-and-forth rotational rocking of the spool bar may allow the knob to be moved more easily. In this unlocked position, teeth 160 of knob 142, no longer contact both gears. Once positioned free of the gears, the knob may be rotated slightly to maintain the knob in this extended position. Slight rotation and then release aligns and mates protrusions 166 (on the outer face of gear 148) with recesses 168 on knob teeth 160. Additional outward pressure on the knob, coupled with slight rotation and then release will return the knob back to its locked position.

The kite controller may include a crank mechanism, also referred to as a crank. A crank mechanism generally comprises any manually powered mechanism that provides a mechanical advantage for rotating the spool bar to wind a control line onto a spool. The crank may be connected to the frame. The crank also may be constantly or releasably fixed relative to the spool bar and/or frame, and may provide bi-directional, one-to-one control of spool bar rotation. Alternatively, the crank may be geared relative to the spool bar, so that one revolution of the crank produces fewer or more than one revolution of the spool bar. The ratio of revolutions between the handle and the spool bar may be fixed or variable. Rather than bi-directional, the crank may be uni-directional in its winding action, for example, acting through a ratchet, similar to that found on a socket wrench. In addition to directing an active spool mechanism, the crank also may be actively or passively coupled to unwinding of lines and/or may be used as a brake.

The crank mechanism 170 may be in the form of an arm 144 extending generally normal to the spool bar axis, with a handle 172 on it distal aspect; see FIGS. 3, 4A, and 4C. Similar to spool bar 84, the crank may have locked and unlocked configurations. In the locked configuration, the crank is fixed in position relative to the frame. This locked configuration may act as a storage position, shown in FIG. 3, in which the arm is disposed adjacent to end region 100. As described above, this locked configuration may be used to fix the position of the spool bar. The locked configuration may be defined by a movable portion of the crank mechanism, in this case handle 172. As shown in FIGS. 3, 4A, and 4C, handle 172 may extend through a hole in the crank arm into a recess 174 in the frame, to prevent crank mechanism 170 from rotating. Outward movement of handle 172 to the unlocked position of FIG. 4C may allow arm 144 to rotate, as shown in dotted outline. The amount of outward force required for outward movement of the handle may be determined by a detention mechanism, such as spring-biased detention pin 176 stored in recess 178 of arm 144. Pin 176 retains handle 112 in the locked configuration by protruding into channel 180 until a sufficient outwardly directed force on the handle retracts pin 176 out of the channel. Complete separation of the handle from arm 144 may be blocked by an enlarged portion of the handle formed in base 182. In other embodiments, a feature of the crank mechanism separate from the handle may be used to produce a locked configuration.

In the unlocked configuration, base portion 182 is disengaged from recess 174. The crank is then rotatable about the axis of the spool bar. Handle 172 may be joined to base portion 182 with a fastener 184 so that the handle rotates freely relative to the crank arm, making the winding motion easier. As described above, knob 142 may be engaged to rotationally couple arm gear 146 to spool bar 84. In this engaged position, rotation of crank mechanism 170 also rotates the spool bar and thus may be used to wind control lines on (or off) the spools.

Figure 5A:
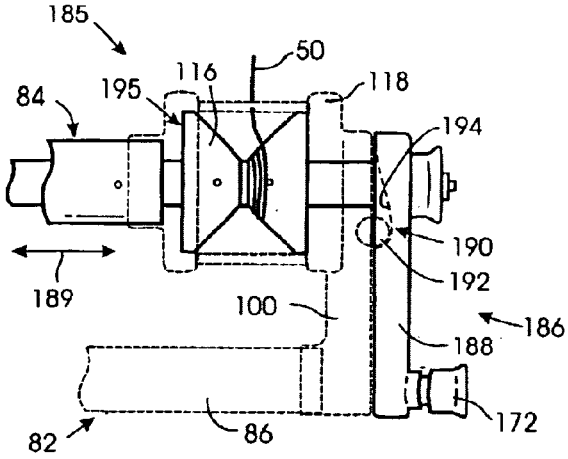
FIG. 5A is a plan view of an embodiment of a reciprocating crank mechanism that may be included in a variable-line kite controller, in accordance with aspects of the invention.

FIG. 5A shows an embodiment of a variable-line kite controller 185 having a reciprocating crank mechanism 186. Reciprocating crank mechanism 186 may couple rotational movement of crank arm 188 to reciprocal motion of spool bar 84 and thus spool 116. The reciprocal motion may be parallel to the rotational axis of the spool bar, shown at 189, and thug may distribute control lines 50 more evenly across the width of the spools, such as spool 116.

Figure 5B:
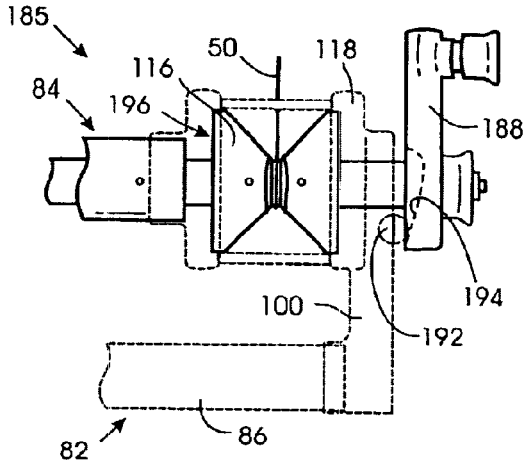
FIGS. 5B and 5C are plan views of the reciprocating crank mechanism of FIG. 5A, with a crank arm of the mechanism in different rotational positions, in accordance with aspects of the invention.
Figure 5C:
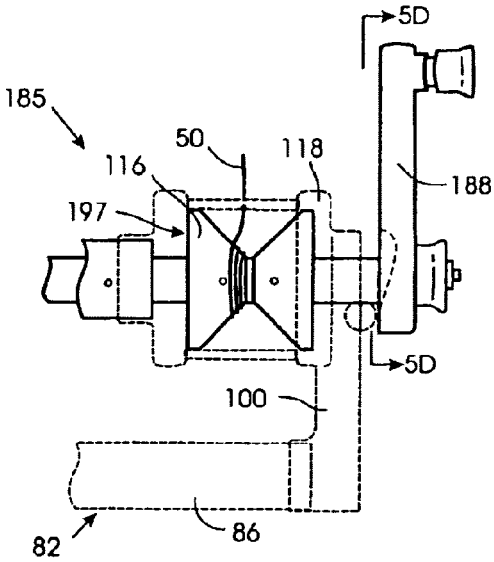
Figure 5D:
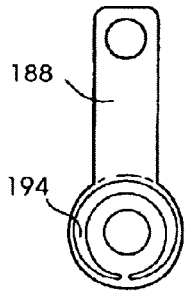
FIG. 5D is a side view of the crank arm of FIG. 5C, viewed generally along line 5D—5D of FIG. 5C.

Reciprocating crank mechanism may include an obliquely oriented guide mechanism 190. The guide mechanism may be defined by a frame protrusion 192 extending from the frame of the kite controller and a track or channel 194 defined by crank arm 188. Channel 194 is also shown in FIG. 5D. Alternatively, the track may be defined by the frame, with a corresponding protrusion extending from the crank arm. In any case, the track may define a surface that is oblique to the rotational axis of the spool bar. Accordingly, contact between the protrusion and the track may create reciprocal movement of the crank arm and spool bar parallel to the rotational axis during rotation of the crank arm.

Reciprocal movement is exemplified by the position of spool 116 with three different crank arm 188 positions. FIG. 5A shows crank arm 188 aligned to frame 82, with protrusion 192 disposed in the deepest region of track 194. In this position of the crank arm, spool 116 may be disposed asymmetrically in housing 118 and farthest from frame end region 100, shown at 195. FIG. 5B shows crank arm 188 rotated about one-third of a revolution relative to FIG. 5A. Protrusion 192 may be in contact with a region of track 194 having intermediate depth. Accordingly, spool 116 may be positioned closer to end region 100 and more centered in housing 118, shown at 196. FIG. 5C shows crank arm 188 rotated about one-half turn relative to FIG. 5A. In this position of the crank arm, protrusion 192 may be in contact with the shallowest region of track 194. Accordingly, spool 116 may be positioned closest to end region 100 and asymmetrical in housing 118, shown at 197.

Figure 6:
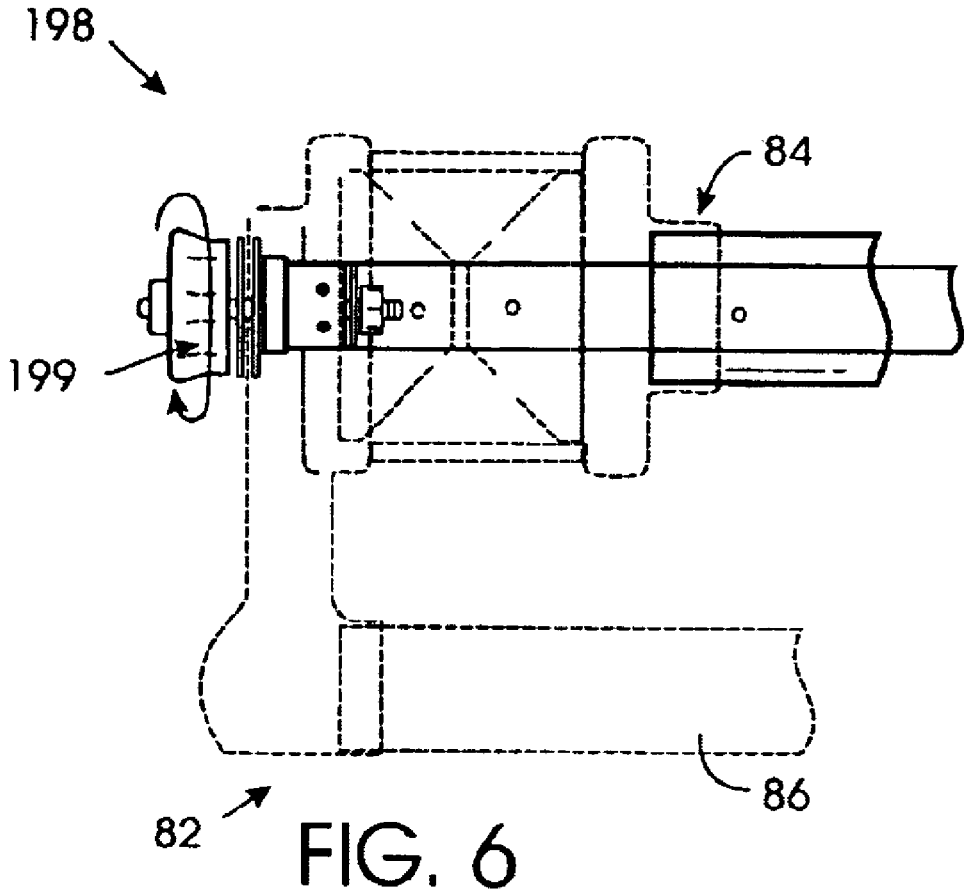
FIG. 6 is a view of a drag mechanism that may be included in a variable-line kite controller, in accordance with aspects of the invention.

FIG. 6 shows an embodiment of a variable-line controller 198 having a drag mechanism 199. Drag mechanism 199 may be considered as another form of a braking mechanism. In particular, the drag mechanism may be configured to adjust the amount of frictional contact between frame 82 and spool bar 84, and may be used alternatively, or in addition to, the hand-braking mechanism described above. The drag mechanism may include a graspable structure, such as a knob, that is rotatable manually to increase or decrease the amount of force necessary to rotate the spool bar. Alternatively, the drag mechanism may be configured to be adjustable with tools, for example with a screwdriver or wrench. In any case, the drag mechanism may be adjustable to change the rate at which the control lines area are deployed, for example, with a change in wind conditions or user skill.

C. Sheeting Mechanisms

This section describes sheeting mechanisms and components thereof that may be used with a variable-line and/or a fixed-line kite controller; see FIGS. 7–12.

Since kiteboarding and related activities with a power kite are conducted in a range of wind conditions, a sheeting mechanism is preferred to control the power exerted by the wind. A sheeting mechanism generally comprises any mechanism that allows the kite operator to independently regulate the effective or deployed length of a subset of control lines. The deployed length measures the distance from the controller (such as the body, a handle, or the frame of the controller) to an attachment site on the kite, generally along one of the control lines. The sheeting mechanism may be used to alter the pitch of the kite, thus changing the amount of wind "spilled" and the force generated by the kite. With a spool bar having fixedly mounted spools, the sheeting mechanism may wind one or plural control lines around the spool bar without rotating the spool bar. This may be effected with an independently rotatable structure such as a housing that acts as a sheeting spool, distinct from the control spools. The sheeting spool may define a distinct path or winding control lines that is of larger diameter, generally coaxial with the path defined by control spools mounted on the spool bar.

Figure 7A:
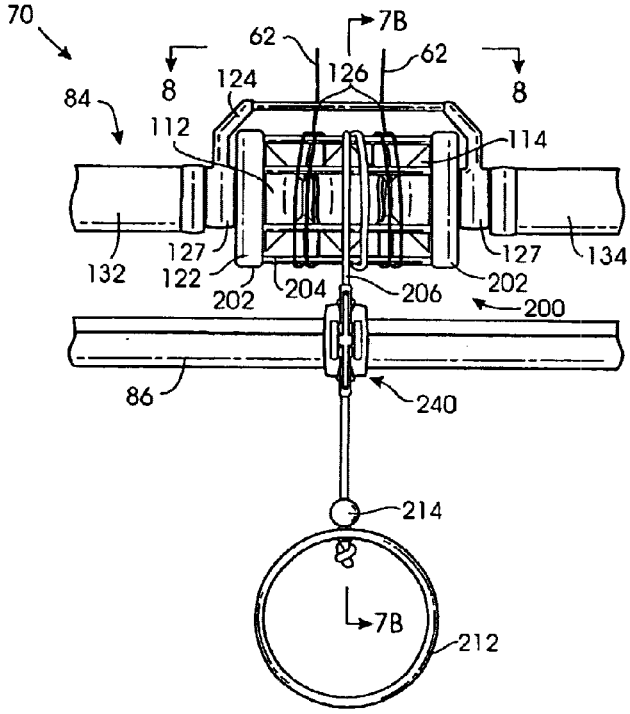
FIG. 7A is a fragmentary plan view of the kite controller of FIG. 2, illustrating aspects of a sheeting mechanism.
Figure 7B:
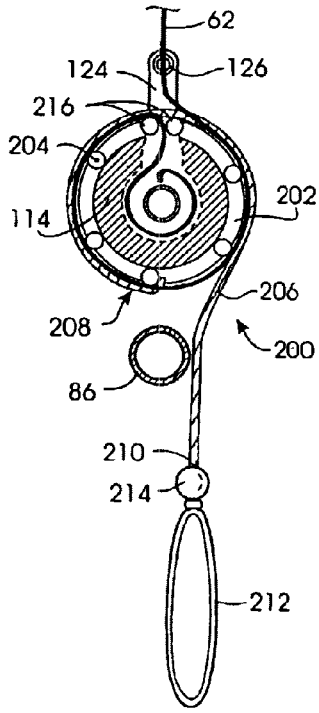
FIG. 7B is a partially cross-sectional view of selected aspects of FIG. 7A, taken generally along line 7B—7B of FIG. 7A.
Figure 8:
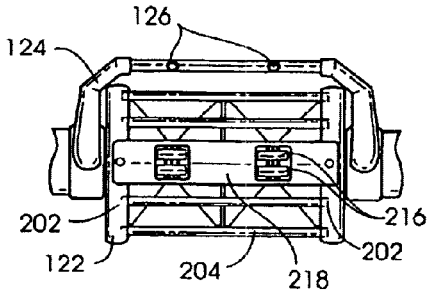
FIG. 8 is a fragmentary view of selected aspects of the sheeting mechanism of FIG. 7A, viewed generally along line 8—8 of FIG. 7A.

A sheeting mechanism 200 used in kite control system 70 may include a sheeting spool controlled by a sheeting regulator; see FIGS. 2, 7A, and 7B. Mechanism 200 uses the central housing as the sheeting spool 122. As described above, sheeting spool 122 is rotatably mounted on the spool bar. Spool 122 may include hubs 202 coupled to spool bar 84, with line support or pins 204 that connect the hubs, extending generally orthogonal to sheeting lines 62. A sheeting regulator 206 may be coupled to sheeting spool 122, generally secured directly, for example, with an end portion fastened to one of the line supports, shown at 208 in FIG. 7B. The sheeting regulator generally comprises any flexible structure or connector that transmits longitudinally directed forces on the regulator to the sheeting spool and may include a line, cord, string, belt, or strip, among others. The sheeting regulator, may be wrapped circumferentially, generally at least one or more times, around the sheeting spool, over the line supports, as shown in FIGS. 7A and 7B. The length of sheeting regulator that is wrapped around the sheeting spool may determine the maximum extent of sheeting for the kite. The sheeting regulator extends away from the sheeting spool, adjacent or through handle portion 86, or toward the operator. A distal end portion 210 of the sheeting regulator may be attached to a sheeting linkage structure or control structure 212, such as a ring, loop, a hook, a bar, a releasable shackle (see FIG. 15), or handle, among others, which may allow the operator to define a longitudinal position of the end portion of the sheeting regulator by translational movements thereof relative to the handle portion. The linkage structure may be any control structure that allows a kite operator to positive and negatively adjust the deployed length of a subset of the control lines independent of the remaining control lines. The linkage structure may be controlled by grasping it with a hand and/or attaching it to a person, such as with a harness, for example, through a harness hook or a releasable shackle. A retainer 214, such as a bead or knot, may be disposed proximal to the linkage structure to limit travel of the sheeting regulator.

Rotation of the sheeting spool determines the deployed length of sheeting lines. As shown in FIGS. 7A and 7B, sheeting spool 122 provides secondary winding paths for sheeting lines 62. These winding paths may be coaxial to primary winding paths around control spools 112, 114. Thus, as the sheeting spool rotates clockwise in FIG. 7B, sheeting lines 62 are brought in through guide 126 of arm 124 and wound onto the sheeting spool, shortening the deployed length of sheeting lines, relative to the steering lines. Floating guide 124 (with apertures 126) generally points, kiteward. In contrast, fixed line guides 216 on the sheeting spool move with the housing and define the angular position at which the sheeting lines extend onto the sheeting spool.

Rotation of the sheeting spool may be determined by a balance of opposing forces, in effect, producing a two way pulley system. One of the forces may be defined by tension on the sheeting regulator, directed longitudinally away from the kite, either by attachment of the sheeting regulator to frame 82 or to the operator. This force tends to rotate the sheeting spool clockwise in FIG. 7B. A second, opposing force is supplied by sheeting lines 62, which exert a kiteward force. This second force tends to rotate the sheeting spool counterclockwise in FIG. 7B.

The kite operator may control sheeting by adjusting the balance between these opposing forces. Sheeting action may be mediated by moving sheeting loop 212 toward or away from the kite. As shown in FIG. 7B, movement of loop 212 toward the operator will rotate the sheeting spool clockwise relative to the spool bar, unwinding a portion of the sheeting regulator from the sheeting spool, and thus coiling sheeting lines 62 onto the sheeting spool. This action will shorten the deployed length of the sheeting lines relative to the steering lines. In contrast, kiteward movement of the sheeting loop will spool the sheeting regulator onto the sheeting spool and unwind the sheeting lines from the sheeting spool, thus increasing the effective length of the sheeting lines, generally providing more kite power. Complete removal of the force exerted through the sheeting regulator generally will cause the sheeting lines to completely unspool from the sheeting spool, producing alignment between guides 126 and 216, and a return to an unsheeted configuration.

Movement of control lines in and out may produce significant frictional wear on the control lines. To minimize this wear, particularly during sheeting, the sheeting spool, lateral housing, and/or other line guides, may guide the control lines through rollers 216. The rollers may be cylinders pivotably coupled to a housing. For example, on housing 122, rollers 216 are mounted on pins (not shown) that are attached to a roller support 218 extending between hubs 202 (see FIG. 8). Support 218 may also hold a second set of orthogonal rollers or guide pins disposed above or below rollers 216 and limiting lateral movement of control lines. Sliding movement of a control line over a roller will cause the roller to rotate about its long axis, thus minimizing frictional wear on the line. In addition, a roller may provide a smooth sheeting motion, where the operator can feel the amount of pull from the kite and adjust accordingly. The rollers may be formed of plastic, metal, or other suitable materials and also may act as guides for one or more lateral housings 118 or for floating guide 124.

Figure 9A:
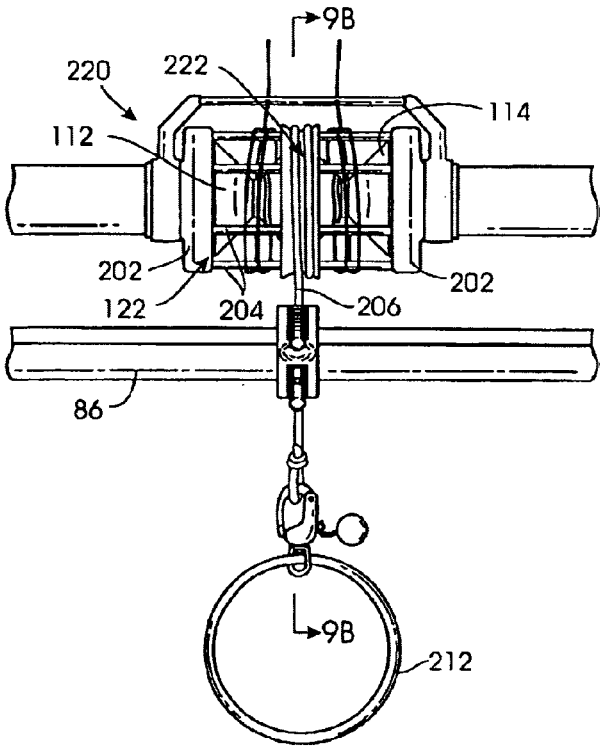
FIG. 9A is a view of an alternative embodiment of a sheeting mechanism that may be included in a kite controller, in accordance with aspects of the invention.
Figure 9B:
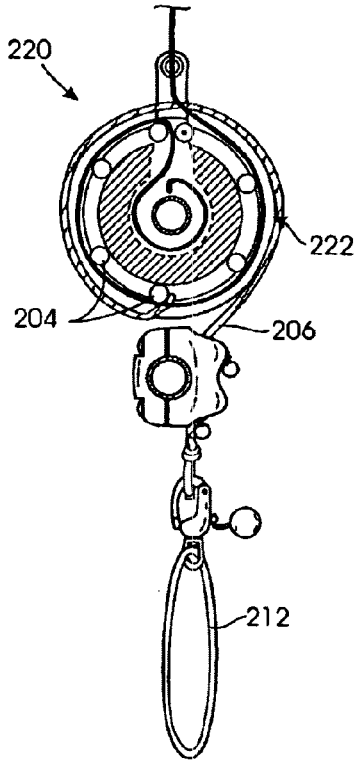
FIG. 9B is a sectional view of the sheeting mechanism of FIG. 9A, viewed generally along line 9B—9B of FIG. 9A.

FIGS. 9A and 9B show an embodiment of another sheeting mechanism 220 that may be included in a variable-line or fixed-line kite controller. Sheeting mechanism 220 may be similar to the sheeting mechanism described above, but also may include a bridge pulley 222. The bridge pulley may define a winding path (and storage site) for sheeting connector 206. In addition, the bridge pulley may increase the strength of sheeting spool 122 by providing support for pins 204.

Figure 9C:
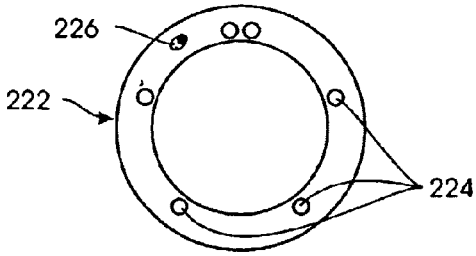
FIG. 9C is a side view of a bridge pulley included in the sheeting mechanism of FIG. 9A.
Figure 9D:
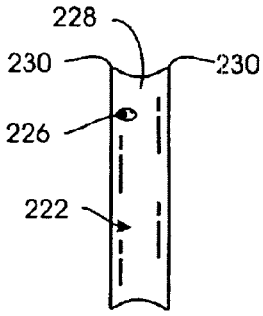
FIG. 9D is a plan vie of the bridge pulley of FIG. 9C.

FIGS. 9C and 9D show side and plan views, respectively, of bridge pulley 222. FIG. 9C shows that the bridge pulley maybe generally annular and may include openings 224 to receive pins 204 (see FIGS. 9A and 9B). In addition, the bridge pulley may include an attachment site or hole 226 for receiving sheeting regulator 206. The attachment site may be a notch or aperture to hold, for example, a knotted end region of the sheeting regulator. FIG. 9D shows the bridge pulley may have a concave outer perimeter to define a channel 228 to direct sheeting regulator 206 between rims 230.

Figure 10A:
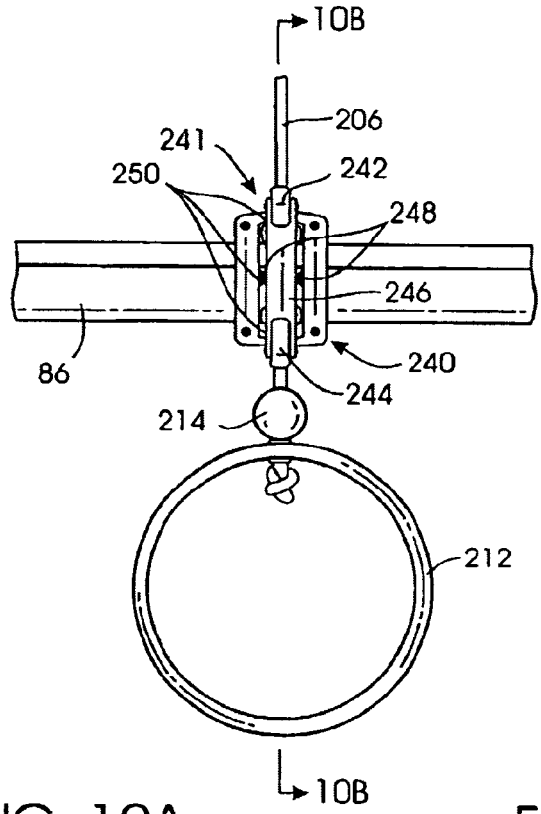
FIG. 10A is a fragmentary plan view of the kite controller of FIG. 2, showing a bi-directional cleating mechanism used to regulate the sheeting mechanism, in accordance with aspects of the invention.
Figure 10B:
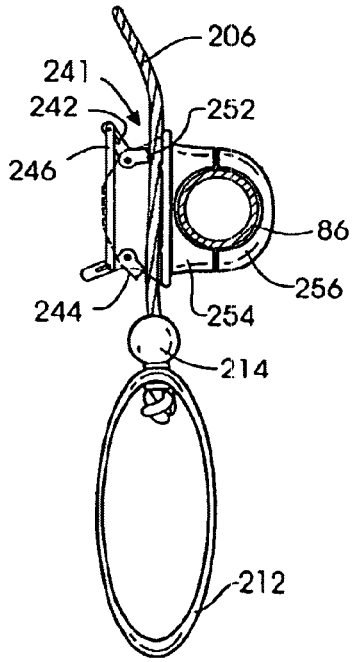
FIG. 10B is a fragmentary sectional view of FIG. 10A, taken generally along line 10B—10B of FIG. 10A.
Figure 11:
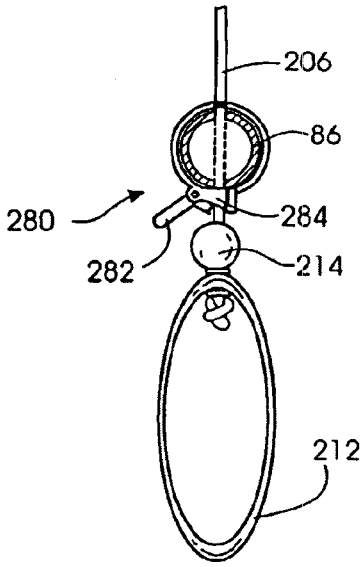
FIG. 11 is a fragmentary sectional view of an embodiment of a uni-directional cleating mechanism that may be used to control a sheeting mechanism, in accordance with aspects of the invention.

The position of sheeting regulator 206 may be defined longitudinally and guided by a cleating mechanism; see FIGS. 10–12. A cleating mechanism generally comprises any mechanism that at least uni-directionally blocks or restricts translational or longitudinal movement of the sheeting linkage structure and/or the sheeting regulator. The cleating mechanism may be a structure that allows the sheeting regulator to be fixed in position adjacent to a region of the kite controller, such as the handle portion or other frame region. For example, the cleating mechanism may be a camp, channel, post, or recess, among others, that bi-directionally holds the cleating mechanism in place.

Alternatively, the cleating mechanism may act uni-directionally. In this case, the mechanism may prevent translational movement of the sheeting linkage structure 212 and/or sheeting connector 206 in one direction to adjust sheeting, but may allow them to move together in the opposing direction to adjust sheeting. For example, the cleating mechanism may be set to enable movement of the sheeting linkage structure 212 and regulator away from the handle portion, to increase the distance of the linkage structure from the handle portion (and negatively adjust the deployed length of the sheeting lines). However, the cleating mechanism may restrict movement of the linkage structure and sheeting connector 206 toward the handle portion, to restrict positive adjustment of the deployed length of the sheeting lines.

A three-position cleating mechanism 240 may be included on controller 80, attached to handle portion 86; see FIGS. 10A and 10B. Cleating mechanism 240 includes a housing 241, which may guide the sheeting regulator, defining the lateral position of the regulator. Mechanism 240 may include opposing cleating arms 242, 244, which act uni-directionally and are pivotably attached to the housing. Each cleating arm has a locking position, in engagement with sheeting regulator 206, and a released position, out of engagement with the regulator. Connector 246 may act to positionally interconnect the two cleating arms. In this embodiment, connector 246 has three mutually exclusive functional positions, which are occupied alternately by sliding connector 246 along its long axis. By sliding the connector, retention pins 248 seat in one of three sets of recesses 250 disposed along the connector to define these three functional positions. FIG. 10B illustrates one of these three positions, in which only cleating arm 242 is engaged with regulator 206. In this engaged position, longitudinal movement of sheeting regulator 206 away from the kite (downward in this figure) is blocked by angled teeth 252 of arm 242, which rotate into locking engagement with regulator 206. In contrast, kiteward sliding movement of regulator 206 is permitted because angled teeth 252 are positioned so that cleating arm 242 rotates slightly (counterclockwise in FIG. 10B) to allow the regulator, to pass. Cleating arm 244 is not in an active position and does not block longitudinal sliding in either direction. In a second, intermediate position of connector 246 (not shown) neither cleating arm is engaged, allowing bi-directional, unconstrained movement of regulator 206. In a third position of lever 246 (not shown), cleating arm 244 is engaged, but arm 242 is not, allowing uni-directional sliding of regulator 206, but in the opposing direction to that allowed by the first position. In alternative embodiments, connector 246 may have only two positions, in which either arm, 242 or 244, is engaged. Alternatively, connector 246 may have four functional positions, adding a fourth position relative to mechanism 240, in which both arms are simultaneously engaged, thus locking the position of regulator 206.

Cleating mechanism 240 may be attached to controller 80 as an add-on accessory. For example, as shown in FIG. 10B, the housing may be attached to a clamp having clamp portions 254, 256. These clamp portions be may joined and tightened with fasteners around handle portion 86 to fix the position of mechanism 240 on controller 80. Alternatively, the cleating mechanism may be directly fastened to the handle portion with threaded fasteners such as bolts or screws, or using adhesives or by welding, among others.

A two-position cleating mechanism 280 may be included as part of a sheeting mechanism; see FIG. 11. Here, mechanism 280 includes a single cleating arm 282 pivotably attached to supports 284. Similar to the action of each cleating arm described above, arm 282 may be positioned in engagement with sheeting regulator 206 to effect a uni-directional restriction to regulator sliding, or arm 282 may be positioned out of engagement to allow unconstrained, bi-directional sliding of regulator 206. In FIG. 11, regulator 206 is guided by holes in handle portion 86, rather than adjacent the handle portion by a housing, as shown in FIG. 10B. The handle portion may include a flanged surface to prevent the regulator from being frayed or damaged otherwise.

The two-, three- and four-position uni-directional cleating mechanisms described above provide the kite operator with several options, based on cleating preference. 1) A two-position cleating mechanism may be used by a kite operator who prefers to ride solely in either the harness bridle or the sheeting loop. The bridle rider may mount the two-position cleating mechanism as shown in FIG. 11. The rider may then pull the sheeting loop and cleat it at a desired position and continue riding in the harness. In contrast, the sheeting-loop rider might reverse-mount the two-position cleating mechanism relative to FIG. 11, to prevent the cleating mechanism from readjusting with every small movement made by the rider. In this reversed position the rider acts as the resistance between the sheeting mechanism and the kite. 2) The three-position cleating mechanism 240 of FIGS. 10A and 20B may give the kite operator the option to ride in either the harness bridle or the sheeting loop at any given time, and an additional, unconstrained position in which the sheeting regulator is freely slidable. This unconstrained position may be used by a sheeting-loop rider who wants to have continual bi-directional control over the sheeting mechanism. 3) A four-position cleating mechanism may eliminate the need for a harness bridle by also providing a bi-directional fixed position for the regulator, allowing the sheeting loop to function as a harness bridle.

FIGS. 12A–E show views of another embodiment of a bi-directional cleating mechanism 285. Cleating mechanism 285 may be connected to the frame of any suitable kite controller.

Figure 12A:
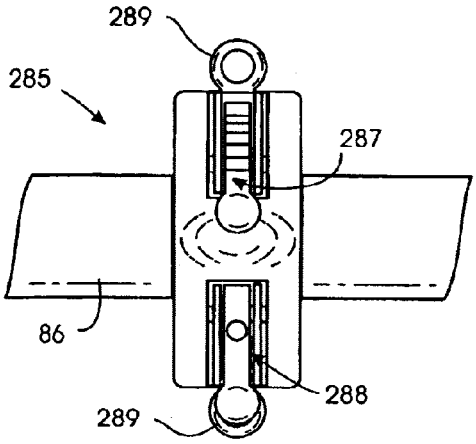
FIGS. 12A–12E are various views of an alternative embodiment of the bi-directional cleating mechanism of FIG. 10A, in accordance with aspects of the invention.
Figure 12B:
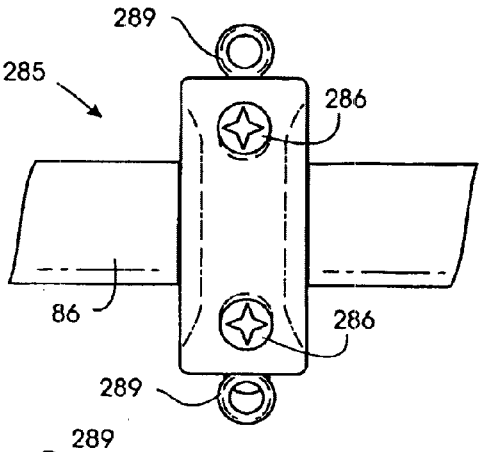

FIGS. 12A and 12B show top and bottom views, respectively, of cleating mechanism 285 mounted on handle potion 86 of a kite controller. The cleating mechanism may be connected to the kite controller with fasteners, such as screws 286, or by any other suitable fastening mechanism. Cleating mechanism 286 may include cleat actuators 287, 288, which may be actuated to engage sheeting regulator 206. Cleating mechanism 286 also may include one or more anchor sites 289 for attachment of one or both ends of a sheeting regulator or flexible connector 206, for example, after the sheeting regulator passes through a pulley mechanism (see below).

Figure 12C:
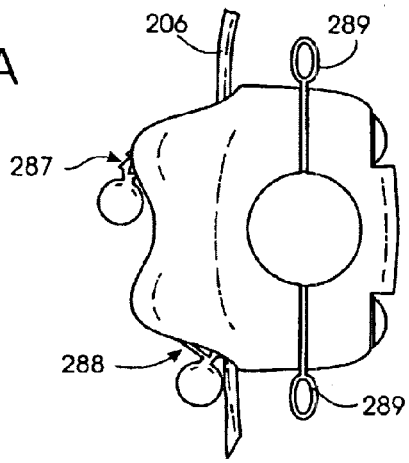
Figure 12D:
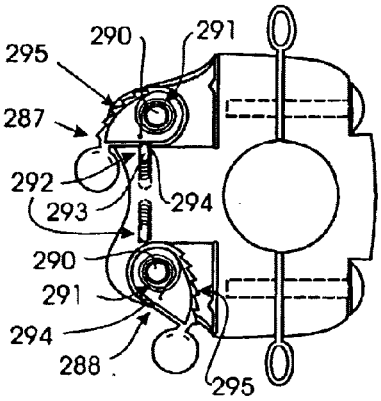
Figure 12E:
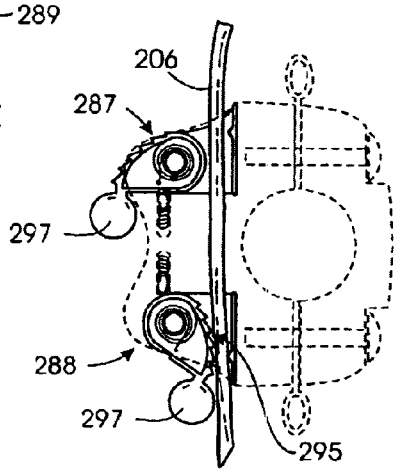

FIGS. 12C–12E show side views of cleating mechanism 285 in the presence or absence of sheeting regulator 206. FIG. 12C shows cleat actuator 287 in a released position and cleat actuator 288 in an engaged position with sheeting regulator 206. FIG. 12D shows a view of the cleat actuators in the same positions, but in the absence of sheeting regulator 206. Each cleat actuator may be mounted pivotably on a post 290 or other pivot point. The cleat actuator may include a biasing mechanism 291, such as a coil spring or leaf spring, among others, to pull the cleat actuator into an engaged position (or into a released position). Each cleat actuator also may include a detent mechanism 292 to retain the cleat actuator in position until actuated. In the present illustration, the detent mechanism includes a biased pin 293 that contacts a recess 294 in each cleat actuator. Each cleat actuator also may include an engagement structure 295 to hold the sheeting regulator in position. The engagement structure may include, for example, asymmetrical ridges or teeth that selectively restrict movement of the sheeting regulator in one of two opposing directions when engaged. The cleat actuators each may include a tab 297 (see FIG. 12E) to operate the actuators with a digit or hand.

D. Safety Mechanisms

Safety is a prominent issue in the design of any kite control system. Thus, kite control system 70 may include safety mechanisms that protect the operator from injury during flying and depowering phases of a kite flying session; see FIGS. 13–15. Safety mechanisms may include line sheaths, a safety release, and/or a quick-release coupling mechanisms. These mechanisms may be suitable for variable-line and/or fixed-line kite control bars.

Figure 13:
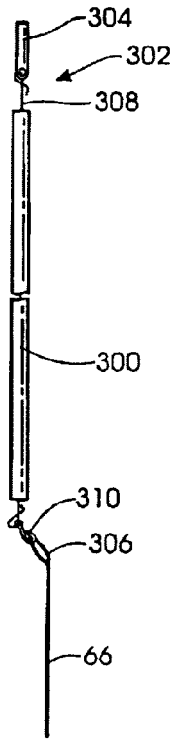
FIG. 13 is a view of a line feeder positioning a kite line relative to a component of a safety release mechanism of FIG. 14A, in accordance with aspects of the invention.

As shown in FIG. 13, line sheaths 300 may be elongate tubes with an inner diameter that is greater than the diameter of the control line, to allow the control line to pass through the sheath easily. Line sheaths may be slidably positioned over any control lines 50, generally a proximal portion of one or plural outer (steering) lines 66. To thread a control line through sheath 300, a line feeder mechanism 302 may be used. Mechanism 302 may include a cylinder 304 or other structure that is easily passed through sheath 300. Cylinder 304 maybe weighted and/or elongate, and may be pushed through the sheath by gravity or an applied force. Cylinder 304 is attached to an end region 306 of control line 66, for example, with a connecting line 308 tied to a hole at one end of cylinder 304 and connected to a control line, such as steering line 66, either directly for by attachment with a blunt hook 310. Alternatively, cylinder 304 may be directly attached to steering line 66. After cylinder 304 is passed through the sheath, steering line 66 follows due to its attachment to the cylinder and then may be attached to the kite (or controller) directly or indirectly.

The size and composition of sheaths may be selected based on functional considerations. As mentioned above, the inner diameter is selected to allow the sheath to slide easily over the control line. The outer diameter of each sheath may be sufficiently large to minimize injury by distributing a lateral force exerted by the control line over a larger area defined by the sheath relative to the control line. The length of each sheath may be at least about 6", 1 ft, or 2 ft for protection from the control line, or at least about half the width of the kite (generally, at least about six feet) for depowering the kite, as described below. Sheaths may be somewhat flexible to facilitate storage, but, when included in the safety release mechanism described below, should be sufficiently rigid to withstand a force applied longitudinally. A suitable material may be a plastic, such as, reinforced PVC tubing.

Figure 14A:
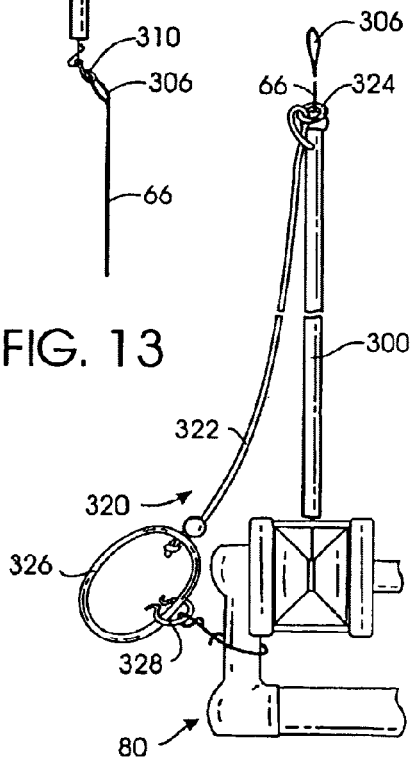
FIG. 14A is a fragmentary plan view of a safety release mechanism disposed on the kite controller of FIG. 2, in accordance with aspects of the invention.
Figure 14B:
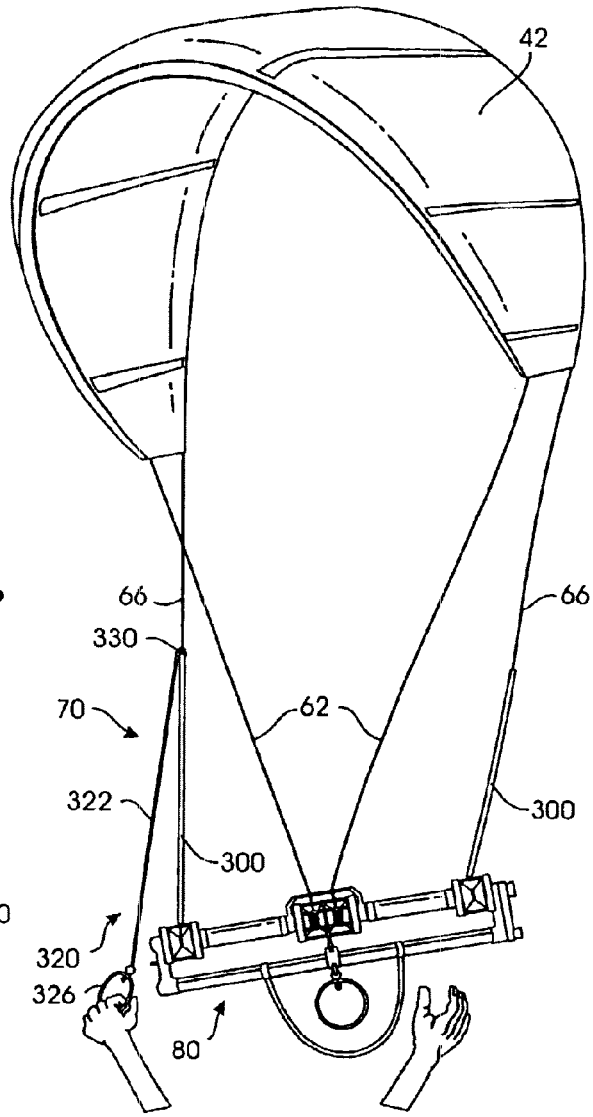
FIG. 14B is a view of the safety release mechanism of FIG. 14A being deployed in the system of FIG. 1, as the person releases the kite controller, in accordance with aspects of the invention.

As shown in FIGS. 14A and 14B, each sheath generally remains proximal to controller 80 during kite operation. Each sheath may be maintained in this proximal position adjacent to the spools by the action of gravity, floating on the control lines, neither connected to the control lines or the controller. However, in some embodiments, the proximal end of the sheath may be mounted on the controller, for example with an adhesive, or the sheath may be more flexibly maintained in association with the controller, for example with tethers connecting the controller to a region of the sheath.

The sheaths may perform at least two functions. First, as mentioned above, each sheath may increase the effective diameter of control lines proximal to the controller, thus reducing the risk of injury from small-diameter control lines. Thus, use of sheaths may allow kite lines to be directly attached to the spools on variable-line controllers, or to eyelets or other attachment structures on fixed-line controllers, without the need for bulky intervening lead lines of greater diameter. Therefore, line sheaths may eliminate a need for storing lead lines on spools thereby reducing spool size and circumventing a need to unspool control line to a minimum length to deploy attached lead lines. Second, a sheath may be a component of a release mechanism, for example, when the operator is unable to control the kite and unlinks from the handle portion of the controller.

A safety release or depowering mechanism 320 may form part of kite control system 70; see FIGS. 14A and 14B. Mechanism 320 includes a release line 322 that is slidably attached to control line 66, for example, with ring 324, a bead, or a loop, among others, joined near or at the end of the release line. The proximal end portion of the release line may include a release handle 326, such as a loop, a ring, or other easily grasped structure. Handle 326, or a proximal portion of line 322, may be coupled to controller 80 with a clip 328 from which the handle can be easily removed, or a ring through which the release line can be slid. Alternatively, the release line may extend through an aperture in a region of the controller frame, such as one of the winding posts. In other embodiments, the proximal end portion of release line 322 may be continually attached to the operator, rather than, or in addition to, the controller. For example, the release line may include an operator attachment feature such as a wrist leash, or other a strap or attachment structure that is configured to attach to the wrist, other body part, or harness of the operator. To minimize tangling of the release line or interference with kite control, the release line may include an inherent spring-like coiled structure, which is readily expandable, or may be elastic. The release line may be slightly or substantially greater than the length of sheath 300, generally about six feet to about twelve feet, and more preferably about nine feet.

A controller may be configured to include a release handle or a wrist leash based on operator skill. The wrist leash may be suitable for beginner-level to intermediate-level kite operators, since kite handling skills are still being developed. Thus, when an uncomfortable or dangerous situation arises, the operator is able to down the kite by letting go of the kite controller. As kite flying skills develop, becoming more second nature, the release handle system may be more suitable. This type of safety mechanism frees the kite operator's hand to perform tricks such as spins, inverts, and a number of transitions. A leash system still may be preferred by expert kite operators that perform tricks, for example, while disconnected from the sheeting loop.

Safety release mechanism 320 may function as shown in FIG. 14B. The kite operator grasps release handle 326 and unlinks otherwise from the kite controller. Alternatively, with a wrist strap or similar attachment structure, the operator simply releases the kite controller. Once released, the distal end of the sheath provides a pivot point 330 at which tension from the release line is applied, which offsets the control lines and depowers the kite, Thus, when the controller is released, the operator maintains connection to the kite through the release line. The use of a release line to depower a kite, suitable lengths for the release line, and suitable positions for the pivot point are described in more detail in U.S. Pat. No. 6,273,369, issued Aug. 14, 2001, which is incorporated by reference herein.

Figure 15A:
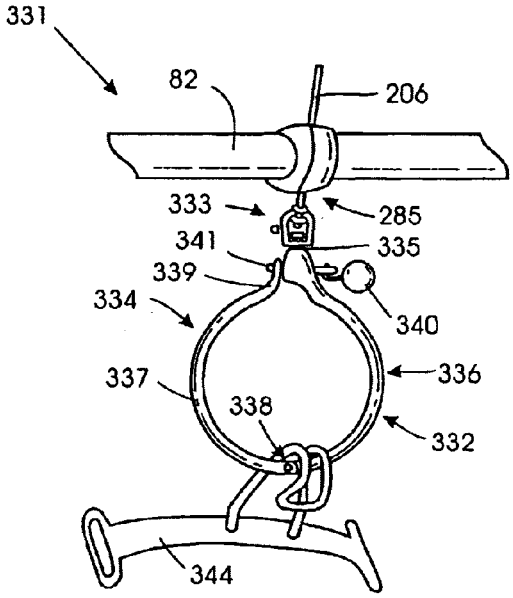
FIG. 15A is a view of selected portions of a kite control system having an embodiment of a quick-release coupling mechanism or shackle that may be used to connect a person to a kite controller and/or as part of a safety release mechanism, in accordance with aspects of the invention.
Figure 15B:
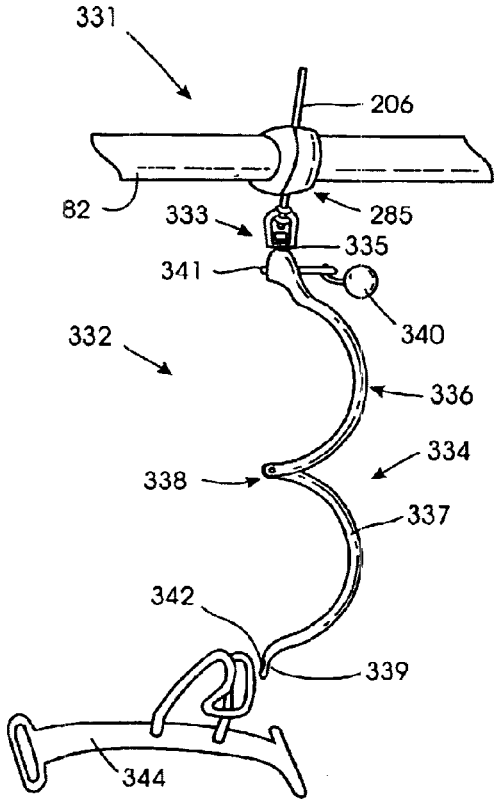
FIG. 15B is another view of the selected portions of the kite control system of FIG. 15A with the quick-release coupling mechanism in an open or released position.

FIGS. 15A and 15B show a kite control system 331 having a quick-release coupling mechanism 332 that may be used to connect a person to a kite controller. This coupling mechanism may be used with variable-line and fixed-line kite controllers. The coupling mechanism may connect a kite controller, particularly a frame or handle portion 82 of the controller, to a person, such as through a portion of a harness 344. In particular, the coupling mechanism may connect sheeting regulator 206 or a sheeting linkage structure of a sheeting mechanism to a person operating the kite. Alternatively, or in addition, the release mechanism may provide a linkage between the person and another portion of the kite controller or may link to a depowering mechanism that connects to a control line, such as a steering line (see FIGS. 14A and 14B).

Coupling mechanism 332 may include one or a plurality of linkage structures, such as connection site 333 and hinged ring or linkage structure 334. Connection site 333 and linkage structure 334 may be fixed relative to one another or may be connected at a pivotable joint 335. Pivotable joint 335 may allow a kite operator to do tricks, just as spin or flips, while remaining connected to the kite controller. Connection site 333 may be any structure that allows connection to the kite operator or the kite controller, for example, through regulator 206. Accordingly, connection site 333 may be a loop, a hook, a ring, etc. Similarly, linkage structure 334 may be any structure configured to allow connection between the kite operator and the kite controller or kite lines. Linkage structure 334 may be a ring of any suitable shape, such as circular, oval, curvilinear, etc., when in a closed position.

Linkage structure 334 may include movable portions 336, 337 that define a hinge mechanism 338. Body portion 336 may be connected to connection site 333. Gate portion 337 may be movable between linked and unlinked positions by pivotal movement about an axis defined by hinge mechanism 338. FIG. 15A shows a linked or closed position in which an end region 339 of the gate portion, distal from the hinge axis, is engaged with body portion 336 to define an annular linkage structure. However, any shape of linkage structure may be suitable. FIG. 15B shows an unlinked or open position in which end region 339 has disengaged from body portion 336, and gate portion 337 has pivoted to release linkage structure 334 from a hook on harness portion 344.

Linkage structure 334 may be changed from a locked or fixed position, in which end region 339 is engaged with body portion 336, to an unlocked or movable position by operation of a manual control 340. The manual control may retract a pin 341 in body portion 336 that engages a hole 342 defined by end region 339 of gate portion 337. The pin may be biased so that it remains in engagement until manual control is operated. In alternative embodiments, gate portion 337 may include manual control 340, so that the kite operator may pull the gate portion out of engagement with the body portion as the manual control is operated. Furthermore, manual control may operate any suitable engagement structure, such as a ridge in a depression, inter-engaged teeth, a bar in a slot, etc.

III. Alternative Variable-Line Control Systems

Figure 16:
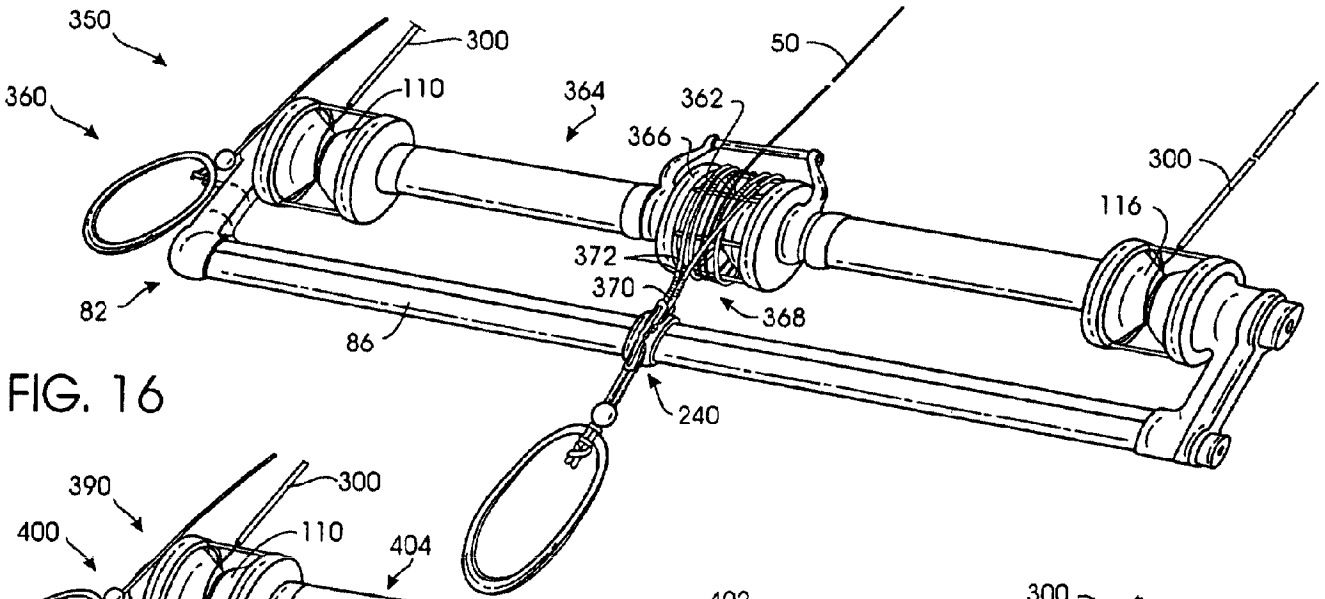
FIG. 16 is a fragmentary perspective view of a kite control system that includes a variable-line kite controller configured to hold three kite lines, in accordance with aspects of the invention.
Figure 17:
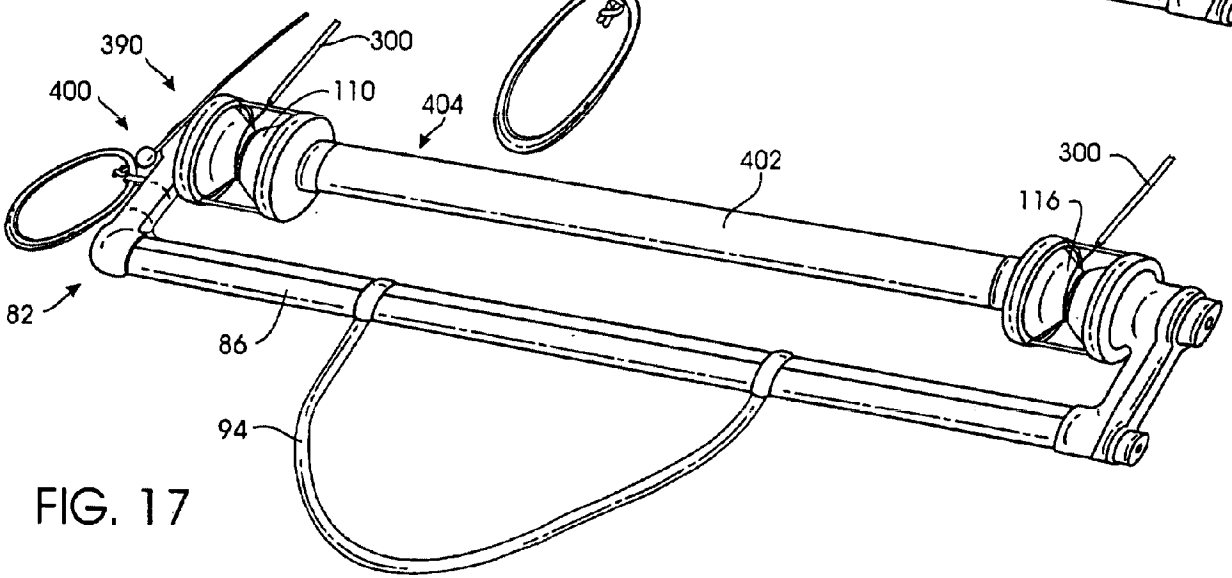
FIG. 17 is a fragmentary perspective view of a kite control system that includes a variable-line kite controller configured to hold two kite lines, in accordance with aspects of the invention.

This section describes others examples of variable-line control systems, which include three-spool and two-spool controllers; see FIGS. 16–17.

Other kite controls systems may use variable-line controllers configured to hold fewer or greater than four lines. For example, as shown in FIG. 16, system 350 includes controller 360 having three spools 110, 116, 362 disposed along spool bar 364. Central spool 362 may be surrounded by a housing that acts as a sheeting spool 366 in sheeting mechanism 368. Sheeting regulator 370 may include two sheeting cords 372 that wind around sheeting spool 366 and extend through cleating mechanism 240. With this arrangement, the central sheeting line 50 may wind centrally on sheeting spool 366, whereas sheeting cords 372 may wind laterally, flanking the sheeting line. In other embodiments, the sheeting regulator may be formed by a single sheeting cord.

As shown in FIG. 17, kite control system 390 includes a controller 400 having two lateral spools 110, 116 but no centrally disposed spools and thus no sheeting mechanism. Brake region 402 may extend uninterrupted between the spools on spool bar 404.

Both controller 360 and 400 may use the same frame 82 to support spool bars 364 and 404, respectively. Frame 82 also supports spool bar 84 in controller 80. Thus, a single frame may accept plural distinct spool bars with varying numbers of spools, but with a common length. As a result, a relatively small number of distinct frame widths may be sufficient to accept a corresponding number of spool bar lengths, but an unlimited number of spool configurations. Similarly, plural frames of varying shapes, but of a common width, may be produced that accept and support a single spool bar.

IV. Fixed-Line Control Bar

This section describes a fixed-line kite control system having a fixed-line control bar with a sheeting mechanism; see FIGS. 18A, 18B, 19A, and 19B.

Figure 18A:
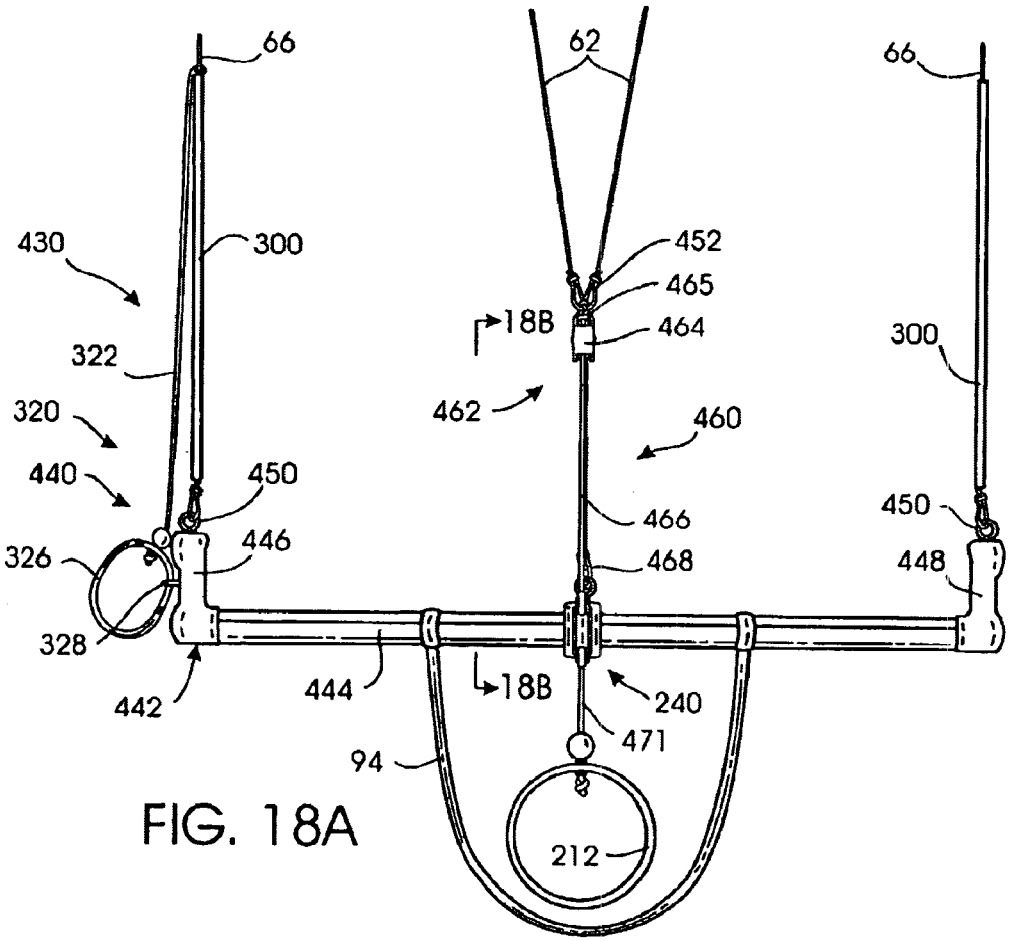
FIG. 18A is a fragmentary plan view of a kite control system that includes a fixed-line kite controller with a sheeting mechanism having a pulley mechanism distal to the handle portion, in accordance with aspects of the invention.
Figure 18B:
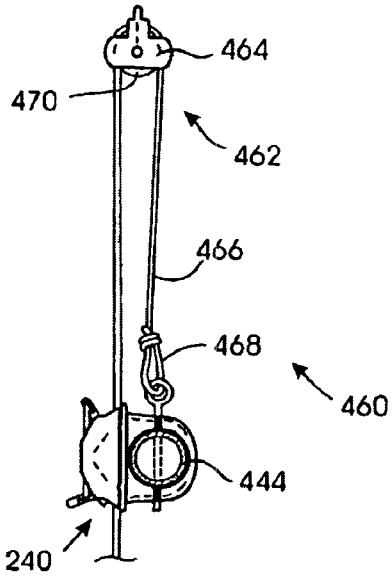
FIG. 18B is a view of the sheeting mechanism of FIG. 18A, taken generally along line 18B—18B of FIG. 18A.

FIGS. 18A and 18B show a kite control system 430 with a fixed-line controller. Kite control system 430 may attach a plurality of three, four, or more kite lines (generally without lead lines) to kite controller 440. Similar to variable-line controller 80, fixed-line controller 440 may be connected to steering lines 66 at lateral positions and may be coupled to one or more sheeting lines 62 at a central position. However, rather than being attached to a spool bar, these kite lines may be coupled to frame 442. Frame 442 includes a handle portion 444 and winding posts 446, 448 that accept steering lines 66. Lines 66 may be attached to eyelets 450 or other loops extending from the winding posts, may extend through apertures in the winding posts themselves, or may be attached suitably otherwise. System 430 may include sheaths 300 and safety release mechanism 320.

System 430 may include a sheeting mechanism 460 to control the relative deployed lengths of the kite lines. The deployed lengths may be measured as the distance from the handle portion to the positrons on the kite at which the lines are connected. The sheeting mechanism may be used to selectively adjust the deployed lengths of sheeting lines 62 relative to steering lines 66. Accordingly, the steering lines may have a fixed length measured from their connection sites on the kite to the handle portion (hence the term "fixed-line controller"), and the sheeting lines may have an adjustable or variable length measured similarly.

The deployed lengths of the sheeting lines may be adjusted by moving a proximal end region 452 of the sheeting lines relative to the frame or handle portion 444 of the controller. Thus, the deployed length may be defined by the sum of a fixed length of the sheeting lines and a variable distance of the proximal end region 452 from the handle portion.

The fixed-line controller may include a sheeting mechanism 460 with a pulley mechanism 462 that provides a mechanical advantage for sheeting. The pulley mechanism may include a pulley housing 464 coupled to a rotatable pulley wheel 465. Proximal end regions 452 of sheeting lines 62 may be attached to pulley housing 464, so that translational movement of pulley mechanism 462 produces a corresponding movement of end regions 452 relative to handle portion 444. A sheeting regulator or connector 466, such as a line, cord, or belt, among others, may be attached at or near a first end portion 468 to frame 442, such as adjacent cleating mechanism 240 (or handle portion 444). Connector 466 may extend around pulley wheel 465 and then back through cleating mechanism 240, to place a second end portion 471 under operator control. As a result, housing 464 is acted on by opposing forces: a kiteward force from sheeting lines 62 and a force directed toward the controller by the sheeting regulator. Translational movement of the sheeting linkage structure 212 (and second end portion 471) toward or away from the kite, with the control lines under tension from the kite, increases or decreases, respectively, the effective or deployed lengths of the sheeting lines. In the present illustration, the deployed lengths of the sheeting lines are changed by half of the distance traveled by of linkage structure 212 (a mechanical advantage of 2:1). Thus, appropriate translational movement of the sheeting linkage structure, coupled with the action of the cleating mechanism, sheets the kite. In other embodiments, sheeting connector 466 may be attached to the sheeting lines without a pulley mechanism, so that a change in longitudinal position of the sheeting linkage structure 212 (and the end of connector 466) produces an equal change in the effective length of the sheeting lines (1:1 ratio). Alternatively, other ratios may be produced with different numbers or positions of pulley mechanisms and/or gears (see below).

Figure 19A:
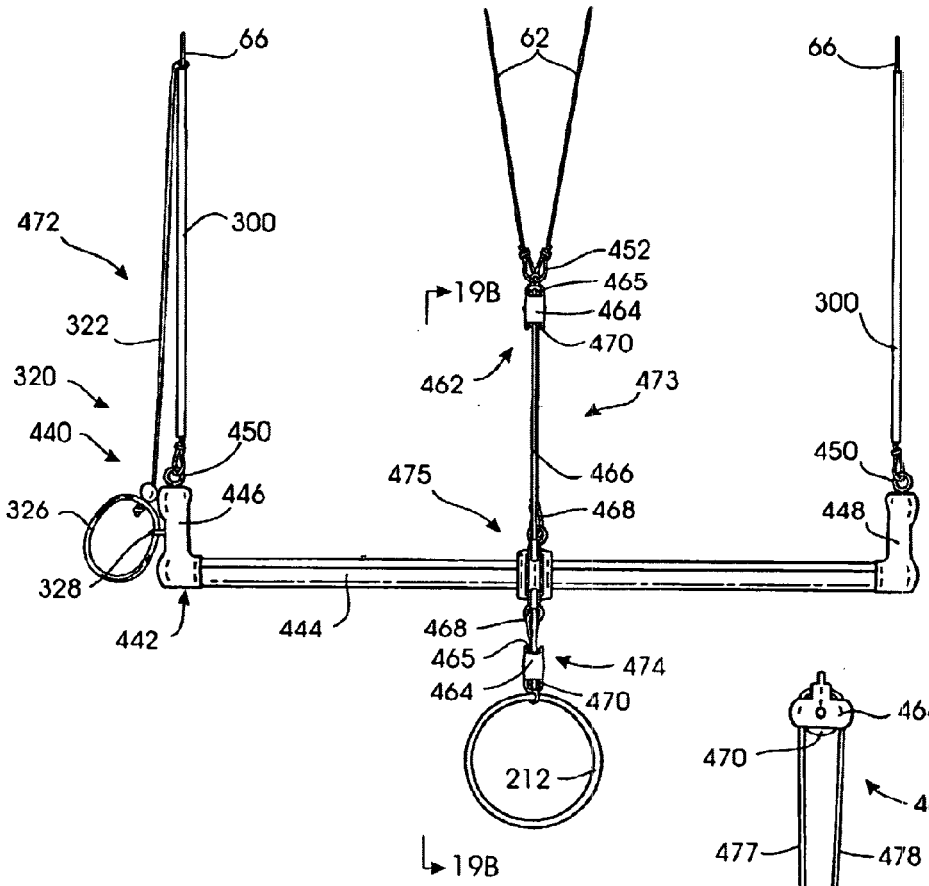
FIG. 19A is a fragmentary plan view of an alternative embodiment of the kite control system of FIG. 18A in which the sheeting mechanism has a plurality of pulley mechanisms, in accordance with aspects of the invention.
Figure 19B:
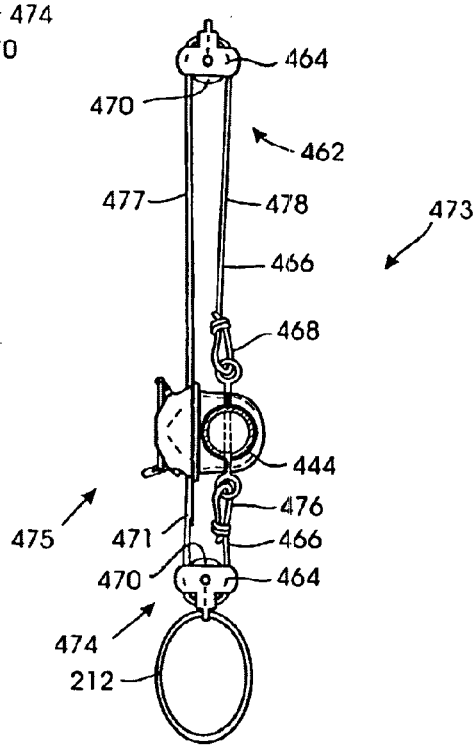
FIG. 19B is a view of the sheeting mechanism of FIG. 19A, taken generally along line 19B—19B of FIG. 19A.

FIGS. 19A and 19B show a kite control system 472 with a different sheeting mechanism 473. Sheeting mechanism 473 may include a plurality of pulley mechanisms, a distal pulley-mechanism 462 (see also FIG. 18A) and a proximal pulley mechanism 474. The proximal pulley mechanism may be disposed between handle portion 444 and sheeting linkage structure 212. Flexible connector 466 may extend around each pulley wheel 465 so that the pulley mechanisms are coupled rotationally. Furthermore, connector 466 may be attached to cleating mechanism 475 through each end portion 468, 476, to fix the positions of the end portions. Cleating mechanism 475 may be a uni-directional or bi-directional cleating mechanism, as desired. In some embodiments, end portions 468, 476 may be attached elsewhere on the control bar and/or handle portion, and the cleating mechanism may be included or omitted, as desired.

Sheeting mechanism 473 may be controlled by moving linkage structure 212 toward or away from handle portion 444, to adjust the deployed length of sheeting lines 62. Translational movement of linkage structure 212 toward handle portion 444 may increase (positively adjust) the deployed length of the sheeting lines. Translational movement of linkage structure 212 away from handle portion 444 may decrease (negatively adjust) the deployed length of the sheeting lines. In each case, the operator may adjust the spacing of the linkage structure from the handle portion by translationally moving the linkage structure relative to the handle portion. This movement may be performed, for example, by moving the handle portion toward or away from the kite operator, without substantially changing the spacing of the linkage structure from the operator.

In sheeting mechanism 473, the mechanical advantage and mechanical disadvantage produced by the distal and proximal pulley mechanisms 462, 474 may offset one another. Accordingly, movement of linkage structure 212 by a distance may produce an equal change in the deployed length, that is, no mechanical advantage (1:1). However, sheeting mechanism 473 may operate more smoothly and may provide greater sheeting control than a 1:1 sheeting mechanism without any pulley mechanisms (see above). For example, the tension on connector 466 may be distributed between connector portions 477, 478, so that portion 477 may slide more easily through cleating mechanism 475.

In alternative embodiments, a sheeting mechanism may include proximal pulley mechanism 474 and no distal pulley mechanism. For example, connector end portion 468 may be connected to end regions 452 of the sheeting lines and connector end portion 476 may be connected to the handle portion after passing through pulley mechanism 474. Accordingly, translational movement of linkage structure 212 by a distance may provide a change in the deployed length of the sheeting lines by two-fold the distance, a mechanical disadvantage of 1:2. In other embodiments, additional pulley mechanisms or gears may be included to provide other mechanical advantages or disadvantages. Use of a harness bridle, sheeting loop, and a cleating mechanism to sheet the kite are described further in Sections II.C and VI.C.

V. Kite Board

This section describes a board for conveying an operator during flying a power kite; see FIGS. 20–23.

Various conveyance structures have been used with power kites on water. For example, skis have been employed, but lack enough surface area for most water conditions, especially at windward tacks and in rough waters. Wakeboards that are designed to carry a rider behind a boat also have gained some popularity for use with power kites. However, these boards lack an ergonomic foot stance to steer the board, because the foot positions are centered longitudinally on the board. Also, these boards lack a substantial tracking fin to create a sufficient resistance to the kite's pull. Therefore, a board is needed that more specifically meets the needs of a kite operator. Specifically, the board needs a proper foil with sufficient surface area to enable a kiteboarder to plane-up quickly and remain on top of the water during lulls in the wind.

Figure 20:
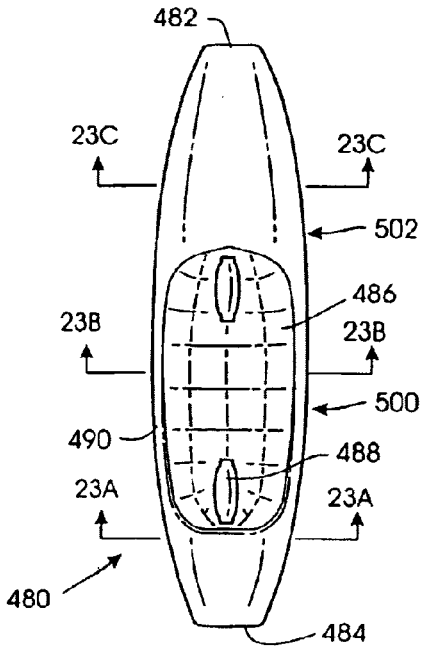
FIG. 20 is a plan view of a kite board for use in power kite systems, in accordance with aspects of the invention.
Figure 21:
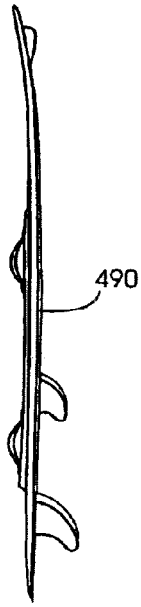
FIG. 21 is a side view of the kite board of FIG. 20.
Figure 22:
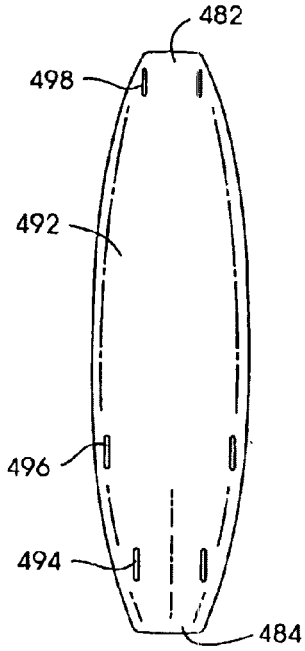
FIG. 22 is a bottom view of the kite board of FIG. 20.

As shown in FIGS. 20–22, kite board 480 may have a generally elliptical shape. Kite board 480 may include a tip 482 and a tail 484, positioned at the front and the back of the board, respectively, when running with the wind. The tip and tail may be truncated, for example, squared-off as shown. The squared off tip and tail may give the board a more effective edge, as compared to a radius tip and tail. The board may be properly foiled with an effective edge, similar to a wakeboard-surfboard hybrid. The foiled (thinned) edge, along with properly placed fins, may enable the kiteboarder to efficiently resist the pull of the kite and travel at all points of sail.

The top of the board may have a concave or scooped pad or deck 486 that is asymmetrically positioned on board 480, and may include foot straps 488. The pad may have a continuous wedge for greater board edge control. Foot straps 488 may extend upward from pad 486, providing generally orthogonal positioning of the operators feet relative to the long axis of the board. The action of applying foot pressure against the wedged portion of the pad would set the board edge precisely. In addition to the pad, a contoured arch support under the foot straps may provide a secured foot placement when performing aerials and tricks. The foot straps may be wide enough to accommodate most foot sizes.

Three pairs of fins extend generally normal to the bottom surface 492 of the board. The skeg fins 494 are positioned at the rear of the board, the fore fins 496 in front of the skeg fins, and the switch fins 498 near the front of the board. The skeg fins and fore fins may have locations that give the board improved steering and stability for kite control. Switch fins 498 may allow the kiteboarder to reverse the direction of board travel, thus placing the switch fins at the back of the board during tacking. As a result, switch fins 498 may provide the kiteboarder with increased tracking and steering capability when tacking. The skeg fins may be larger than the fore fins. In an exemplary embodiment, the skeg fins may be positioned so that there is about 9" from the tail of the board to the center of the skeg fin. In another exemplary embodiment, the fore fins may be positioned so that there is about 22" from the tail of the board to the center of the fore fin. Furthermore there may be a distance of about 1" to 2" from the outline of the board to a parallel aft fin edge. The switch fins may be positioned so that there is about 4" from the tip of the board to the center of the switch fin.

Figure 23A:
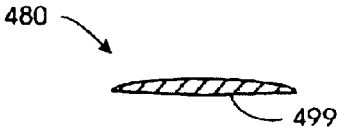
FIG. 23A is a sectional profile of the kite board of FIG. 20, viewed generally along line 23A—23A of FIG. 20.
Figure 23D:
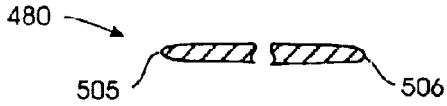
FIG. 23D is a composite of fragmentary views of two alternative sectional profiles that may replace the sectional profile of FIGS. 23B and/or 23C in the kite board of FIG. 20.
Figure 23B:
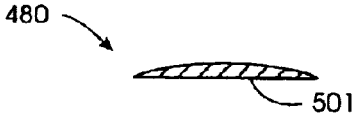
FIG. 23B is a sectional profile of the kite board of FIG. 20, viewed generally along line 23B—23B of FIG. 20.
Figure 23E:
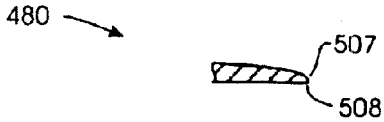
FIG. 23E is a fragmentary view of an alternative sectional profile that may replace the sectional profile of FIG. 23A in the kite board of FIG. 20.
Figure 23C:
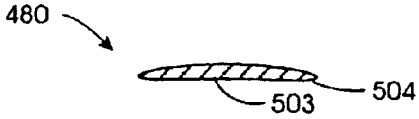
FIG. 23C is a sectional profile of the kite board of FIG. 20, viewed generally along line 23C—23C of FIG. 20.

Each lateral edge 490 of the board may have a foiled configuration, in which the edges thin substantially, to promote maneuverability on the water FIGS. 23A–C show top-surface profiles that maybe include in the kite board. The top surface may be flat or convex. FIG. 23A shows a convex "V" bottom surface 499 that may be included in the kite board, particularly between tail 484 and rear intermediate position 500 (see FIG. 20). FIG. 23B shows a flat bottom surface 501 that may be included in the kite board, particularly between rear intermediate position 500 and front intermediate position 502. FIG. 23C shows a concave or "tunnel" bottom surface 503 with a beveled rail 504 that may be included in the kite board, particularly between front intermediate position 502 and tip 482.

FIGS. 23D and 23E show alternative sectional profiles that may be included in kite board 480. FIG. 23D shows a full radius 505 (on the left) and a tucked rail 506 (on the right), which may be included in the kite board between rear intermediate position 500 and tip 482. FIG. 23E shows a thin radius 507 and a sharp rail 508 produced by a planar surface meeting a curved surface, which may be included in the kite board between tail 484 and rear intermediate position 500.

FIG. 21 shows that an edge profile of the board may deviate from linearity to produce a rocker line. The board may be asymmetrical when viewed edge-on, with the front portion of the board bending further from linear than the rear portion. The edge profile may be evident at the tip of the board due to the foiled-out top surface in contrast to the convex bottom surface. Rail or edge design may start as a thin radius to a thin radius with tuck, defining the bottom outline. Running aft from the fore fins to the tall of the board, the edge shape may become more apparent as thin radius tuck to a thin radius to sharp rail. The wide point may be slightly aft of the center length of the board and the top deck may be either flat or slightly convex. The bottom of the board may have a flat or a concave surface, and may include a slight "V" running towards the tail. Other combinations of these surfaces may be suitable.

Board 480 may be formed by any suitable methods and of any suitable materials. The board may be hand-shaped and laid-up and/or produced by molding processes. The board may have a foam core, either open or closed cell in form. The board may be covered with a fiberglass composite. Layers of glass cloth may be resin coated and laminated to the foam core to provide the core with rigidity. An outer shell of plastic pigment resin and/or durable paint may be applied. The kite board may be lightweight, strong, durable, and waterproof.

VI. Rigging and Operating Kite Control System

This section describes how kite control systems of the invention, including fixed-line and variable line controllers, may be rigged and operated, particularly for kiteboarding; see FIGS. 24–28.

A. Rigging a Kite and Organizing Control Lines

Figure 24A:
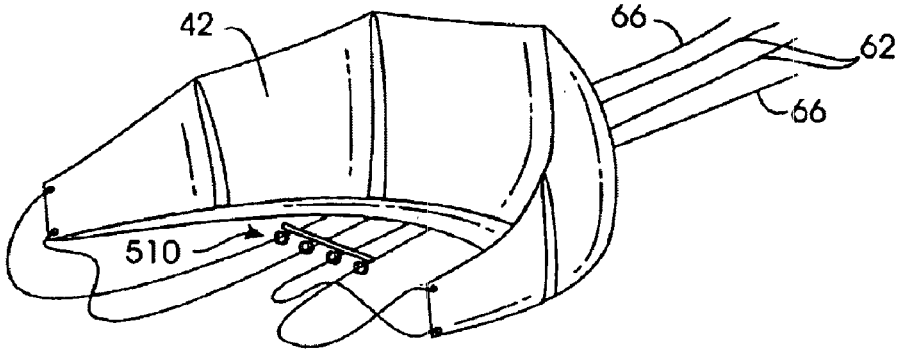
FIG. 24A is view of a line slider organizing kite lines of a power kite, in accordance with aspects of the invention.
Figure 24B:
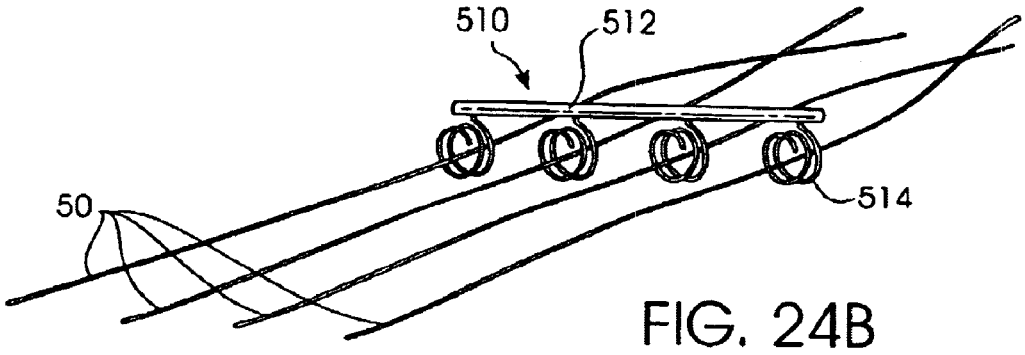
FIG. 24B is another view of the line slider of FIG. 24A.

This section describes how control lines may be attached to a kite and a kite control bar using a line stretcher and/or a line feeder to assist in measuring and organizing control lines; see FIGS. 24A and 24B.

Two-, three-, and four-line kite controllers generally use equal lengths for the control lines that extend between the controller and kite. Line equalization may be achieved by accurately measuring each individual line to exact lengths. However, slight differences may still exist, due to line stretching. Even slight differences may cause the kite to steer incorrectly, favoring one side, or, worse still, spiral out of control. To more precisely equalize line lengths, a line stretcher may be used (not shown). Such a stretcher may be produced by fixedly positioning plural hooks along a bar, so that the hook spacing matches the spool or attachment-site spacing on the controller. After securing the line stretcher to a fixed object, the kite lines are attached to the line stretcher, and the desired full length of each kite line is laid out and tied to the kite controller. Once lines are tied, the lines are stretched by pulling the controller away from the line stretcher. Discrepancies in line length are exhibited as line sag, which may be corrected by retying the appropriate lines.

Attaching lines in the correct spatial relationship between a kite controller and a three-, four-, or more-line kite may be important. If done incorrectly, the kite may spiral out of control, potentially taking the operator along too, if the operator is hooked into the harness. To avoid this problem, a line slider may be used, as shown in FIGS. 24A and 24B. Line slider 510 has a frame 512 with plural line guides 514. The frame may be a bar, a tube, a beam, or any other generally linear support structure. The frame may be relatively small, such as a bar of about ¼" to about ½" diameter, with a length of about 4" to about 10". A specific embodiment has a diameter of ⅜" and a length of 6". The plural line guides (in this case four, to match the four lines) may be in the form of spaced, helical or spring-like coils. Generally, at least about one-and-one-half coils, about two coils, or about two and a half coils may be sufficient to hold kite line 50 in place within the guide. The coils are spaced at least enough for the kite lines to slide easily through adjacent coils.

Guides 514 of line slider 510 allow a middle portion of each kite line to be positioned within the central hole of each guide, without threading from the end of the kite line. Furthermore, this positioning can be reversed and the line removed from the guide at any position along the kite line after the kite lines have been rigged to the kite. To position each kite line on a line guide, a middle portion of the line may be introduced at one side or between any of the coils and then wrapped around the guide to follow the direction of the coils. To remove, the procedure is reversed. Alternatively, before rigging, an end of the kite line may be directly threaded through the central hole of the guide.

Once all four lines are in the center of the coils, one can slide the line slider the length of the lines, removing any twists ahead, while keeping proper spacing behind. These twists may result from storing kite lines on winding posts of a kite controller, in which case each line might have twists extending throughout its stored length. Once these twists are removed, the line slider may remain on the kite lines until the kite is rigged correctly. Alternatively, the operator may wish to attach the line slider before the kite is unrigged, allowing the operator to wind the kite lines around the winding posts until reaching the kite, then unrigging the kite but leaving the line slider still attached to the kite lines. In this case, the line slider would act as a line organizer to mark the relative position of each line. Thus, the operator may not have to slide the line slider the length of the lines to correctly rig the kite prior to a new kite flying session.

Further aspects of line sliders and line-sliding systems are included in the patent applications listed over under Cross-References to Priority Applications and incorporated herein by reference, particularly U.S. Provisional Patent Application Ser. No. 60/429,116, filed Nov. 25, 2002.

B. Launching the Kite

Figure 25:
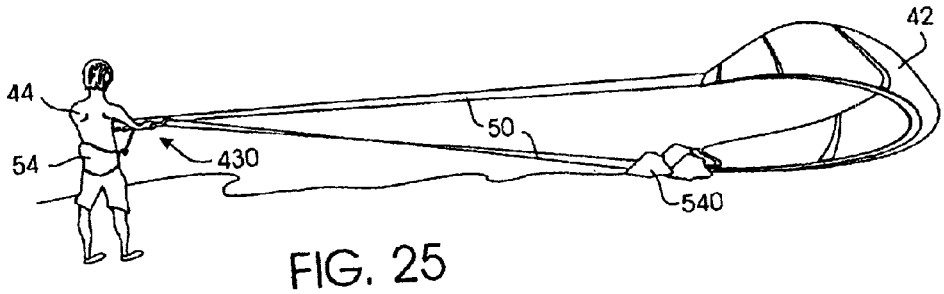
FIG. 25 is a view of a kite control system positioned for self-launching a kite with control lines extended, in accordance with aspects of the invention.
Figure 26:
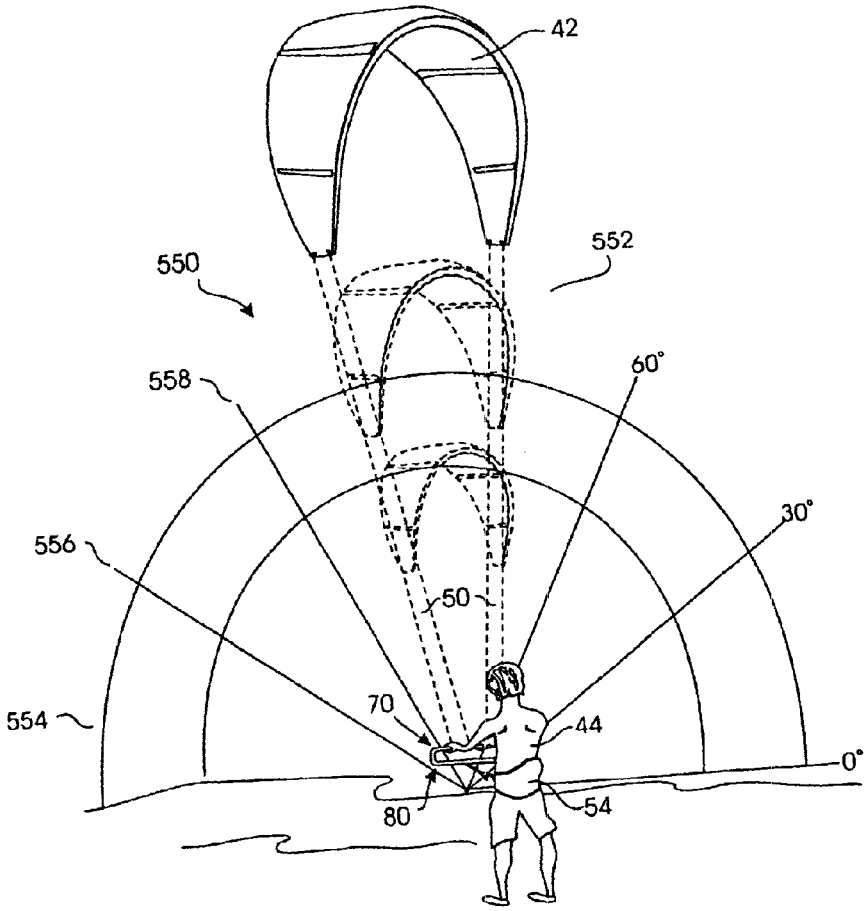
FIG. 26 is a schematic view of a person extending kite lines for a power kite using the variable-line kite controller of FIG. 2, showing the relative positions of four wind zones, in accordance with aspects of the invention.
Figure 27:
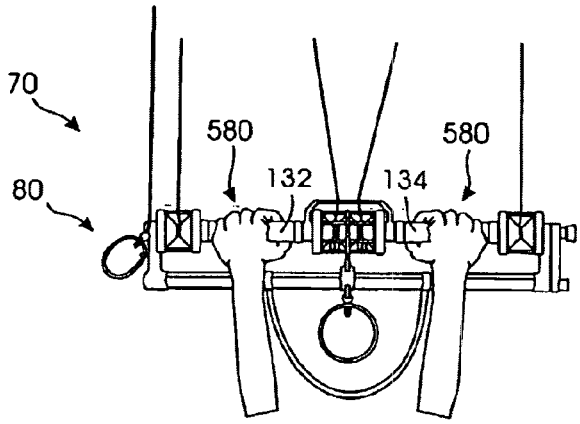
FIG. 27 is a fragmentary plan view of the kite control system of FIG. 2, with a person's hands operating the brake mechanism during a kite launch, in accordance with aspects of the invention.

This section describes the launching phase of kite flying, particularly self-launching with either a fixed-line or variable-line controller; see FIGS. 25–27. For the purposes of this disclosure, launching includes lifting a kite from the ground so that the kite is supported by the wind, and, with the use of a variable-line controller, extending control lines with optional hand braking to a desired length.

A method for self-launching a kite is shown in FIG. 25. This method may be used for either fixed- or variable-line controllers, but is generally more suited for a fixed-line controller. This method nay be used when ideal circumstances apply, such as unregulated wide-open areas, or long stretches of beach, but when an assistant is not available. Here, the kite is held in position by piling sand 540 on a corner of the kite and/or on the control lines. The kite operator then extends the control lines and the kite is held in a generally upright position by tension on the control lines coupled with force of the wind. By pulling the controller, the kite is dislodged from the sand and begins to fly.

Self-launching may be greatly facilitated by using a variable-line controller, such as control bears 80, 360, or 400. FIG. 26 shows early phases of kite flying within a wind window 550 after launching with variable-line kite control system 70. As indicated, the kite may be launched by the operator with very short lengths of control lines extended. The operator may allow the wind 16 carry the kite upward in the neutral zone 552, generally avoiding the turbulent zone 554, the power zone 556 and moderate zone 558 as control lines are extended. The kite positioned in the neutral zone of the wind window minimizes horizontal forces on the operator and achieves maximum kite stability. In contrast, launching a kite with fixed lines generally requires that the kite climb through the turbulent, power, and moderate zones with the control lines fully extended. The ability to launch the kite with short lengths of control lines extended may provide a mechanism for launching the kite in close proximity to the operator in congested, high traffic areas, frequently without assistance, and an ability subsequently to extend the control lines to increase kite mobility, stability, and force generation.

FIGS. 25 and 26 show the kite operator lacking a conveyance device. However, a variable-line controller may allow the operator to launch the kite in the water while positioned with feet in the straps of a kite board or with the board positioned nearby, for example, using board 480 of FIG. 20. Board 480 is designed to plane up quickly when the kite is maneuvered into power zone 556.

FIG. 27 illustrates hand position 580 that may be used during kite launching and extension of control lines from the controller. Hand position 580 places hands on the spool bar, with each hand grasping a brake region 132, 134. This hand positions allows the operator to steer the kite and control the rate of line output (brake the kite) at the same time without moving the hands or fingers laterally. Brake regions 132, 134 provide the controller with a braking system that is generally effective, simple in design, and easy to use. In addition, the braking system is safe because it minimizes the tendency to lose control of steering. The forces exerted by the kite are the same amount one experiences during a kiting session. By applying a moderate squeezing-type grip after the spool bar has been unlocked to allow free rotation (see Section II.B), the operator can regulate the amount of kite line, and the speed of output, by simply stopping or slowing the rotation of the spool bar. This is referred to as feathering the kite out. Feathering the kite depends on wind velocities. Typically, the first 15 meters requires the most feathering attention as the kite climbs through turbulent zone 554 near the surface of the water. With proper feathering, the kite only exerts partial force on the control lines and still flies true. After 15 meters the kite becomes more stable and flies more predictably. By having this type of launching and braking system the operator can feel and gauge the power of the kite, and stop or adjust the rate of control-line release and the kite altitude, based on the operator's skill, comfort level, and/or desired kite altitude.

The altitude selected for kite flying may be important for kite handling. Thus, the control lines may be marked at defined intervals to help the operator keep track of the length of line that has been released. For example, if a kite is flown comparatively at 20 and 27 meters, at 20 meters the kite will respond more quickly, because there is less drag on the control lines. Thus, an operator may elect a kite altitude based on the desired speed, of response. This ability to control kite altitude and length, offered by a variable-line controller, may be especially helpful with larger kites, since they move through the wind window more slowly.

Once a desired kite altitude and/or length of extended control line have been reached, the kite operator readies the controller and control lines for kiteboarding. The spool bar may be fixed in position by activating locking mechanism 140 (see Section II.B); and the operator's hands generally are re-positioned to handle portion 86 at this time.

C. Sheeting the Kite

The kite operator may select a sheeting system and controller linkage suited to personal reference; see FIGS. 7–12, and 18. If the kite operator is attached to a harness bridle, the kite may be sheeted to a desired pitch by pulling sheeting loop 212 a desired amount toward the operator and then uni-directionally fixing this position by activating cleating mechanism 240, specifically cleat arm 244. This cleat arm prevents kiteward movement of the sheeting line. At any time the kite may be depowered further by pulling sheeting loop 212 toward the operator without changing position of the cleating mechanism. However, if the kite operator prefers to be attached to the controller by attaching the harness to the sheeting loop, cleat arm 242 may be activated. In this case, the kite operator provides resistance for kiteward movement of the sheeting line. Thus, at any time, sheeting may be reduced (and the kite power increased) by bringing the controller toward the operator. Alternatively, the operator may ride without either cleating arm activated, but linked to the sheeting loop. In this case, movement of the controller toward or away from the operator will decrease or increase sheeting, respectively. Additional aspects of sheeting mechanisms, cleating mechanisms, and operator linkage to sheeting mechanisms are described above in Section II.C.

D. Landing the Kite and Retrieving Control Lines

Figure 28:
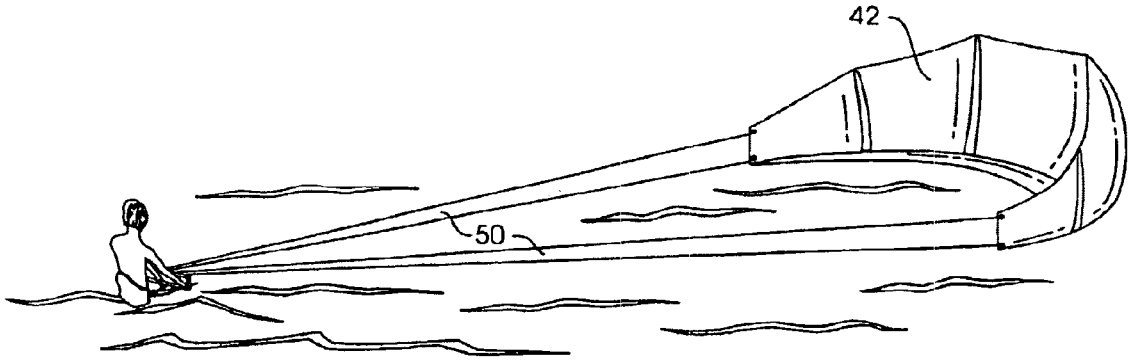
FIG. 28 is a view of landing a kite with a fixed- or variable-line kite control system, in preparation for winding the control lines onto a control bar, in accordance with aspects of the invention.

This section describes how the kite may be landed and the control lines retrieved; see FIG. 28. To land the kite, the operator may fly the kite to the edge of the wind window, dump the kite by turning it upside down, and then let it drift directly downwind. The operator then flips the controller over to remove twist in control lines 50. The inverted kite is now greatly depowered and in a position safe from spontaneous re-launching. With variable-line controller 80, the crank may be released by extending handle 172 out of engagement with the frame. The crank may then be used to rotate the spool bar, thus retrieving the line (see Section II.B). By staying hooked into the harness line, the operator has added leverage while winding the crank. The operator can stop winding the crank at any time and lock the handle when necessary. With a fixed-line controller, the operator may wind the lines around the winding posts.

VII. Comparison of Two-Line and Four-Line Kite Control Systems

This section compares aspects of two-line and four-line kite control systems.

A. Two-Line Systems

For simplicity a two-line kite control system makes sense, particularly where wind speeds are constant, such as trade winds. A bridle system supports a kite so that it can be controlled with only two lines. However, a two-line kite retains its amount of exerted force throughout its flight path within the wind window. Thus, the conveyance means becomes important in controlling the amount of force or pull exerted by the kite. In this case, a board with sufficient surface area, a tracking fin, and an effective edge may be important.

With two-line kiteboarding the board may work by using the boards edge, creating resistance to the pull of the kite. By this action, one can remove the kite to the edge of the wind window, thus reducing the exerted force of the kite and allowing the rider to maneuver. Other means of kite control may include flying the kite in the upper area of the wind window, from the 11:00 to 1:00 range. This may give the rider time to maneuver without being overpowered.

B. Four-Line Kite Control Systems

Four-line kite control systems may take the kiteboarder to a higher performance level, with the addition of sheeting lines and a sheeting mechanism. The sheeting lines also may eliminate the need for a bridle system. A sheeting mechanism may be used to control the sheeting lines in at least two different methods. 1) The kiteboarder is hooked into a harness bridle, and adjusts the kite by pulling the sheeting regulator and fixes its position with a cleating mechanism. This may depower the kite slightly or a great amount, but not totally. Then the kiteboarder may ride at a desired comfort level. 2) A rider may hook into a sheeting loop and perform all the actions while in the loop. The advantages of the sheeting loop may be that the rider can constantly adjust the exerted force of the kite, with changing wind velocities.

The disclosure set forth above may encompass multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and nonobvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements. It is, believed that the following claims particularly point out certain combinations and subcombinations that are directed to one of the disclosed inventions and are novel and nonobvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A device for controlling a power kite, comprising:

a graspable handle portion;

at least three control lines that operatively tether the handle portion to separate positions on the kite, each control line having a deployed length; and a sheeting mechanism including a linkage structure adapted to move translationally to positively and negatively adjust the deployed length of a subset of the at least three control lines, independent of the deployed length of the remaining control lines.

2. The device of claim 1, the deployed length of each control line being measured from the handle portion to a position on the power kite at which the control line is connected.

3. The device of claim 1, wherein the sheeting mechanism includes a flexible connector that connects the linkage structure to the subset of control lines.

4. The device of claim 3, wherein the connector is selected from the group consisting of a line, a cord, a strip, and a belt.

5. The device of claim 1, wherein the sheeting mechanism includes a pulley mechanism.

6. The device of claim 5, wherein translational movement of the linkage structure relative to the handle portion adjusts spacing of the pulley mechanism from the handle portion.

7. The device of claim 5, wherein the pulley mechanism is configured to be disposed generally between the handle portion and the power kite during operation of the power kite.

8. The device of claim 5, wherein the pulley mechanism is configured to be disposed generally between the handle portion and a person operating the power kite.

9. The device of claim 5, wherein pulley mechanism includes a plurality of pulley mechanisms that are rotationally coupled.

10. The device of claim 9, wherein the sheeting mechanism includes a flexible connector coupled to each of the pulley mechanisms and having a pair of end regions, and wherein each of the end regions is fixed in relation to the handle portion.

11. The device of claim 9, wherein translational movement of the linkage structure by a distance is configured to move each of the plurality of pulley mechanisms by the distance.

12. The device of claim 1, wherein the linkage structure is configured to be connected to an operator of the power kite so that the operator can move the handle portion relative to the linkage structure during operation of the power kite to produce relative translational movement of the linkage structure.

13. The device of claim 1, wherein the device is a variable-line controller.

14. The device of claim 1, wherein the device is a fixed-line controller.

15. The device of claim 14, wherein the subset of control lines for which the deployed length is adjusted has a fixed length measured from the sheeting mechanism to the power kite.

16. The device of claim 14, wherein each control line of the subset includes a proximal end region connected to the sheeting mechanism, and wherein the deployed length of the subset of control lines is defined by summation of a fixed length measured from the proximal end region to the power kite and a variable length measured from the proximal end region to the handle portion.

17. The device of claim 1, wherein the sheeting mechanism includes a cleating mechanism that is actuable to restrict at least one of negative and positive adjustment of the deployed length of the subset of control lines.

18. The device of claim 17, wherein the cleating mechanism is actuable to selectively restrict only one of negative and positive adjustment of the deployed length of the subset of control lines.

19. A device for controlling a power kite, comprising:

a graspable handle portion;

at least three control lines that operatively tether the handle portion to separate positions on the kite, each control line having a deployed length; and means for positively and negatively adjusting the deployed length of a subset of the at least three control lines, independent of the deployed length of the remaining control lines, by translational movement of a linkage means.

* * * * *